US010369486B2

(12) United States Patent
Santos

(10) Patent No.: US 10,369,486 B2
(45) Date of Patent: Aug. 6, 2019

(54) TOY VEHICLE LAUNCHER

(71) Applicant: Mattel, Inc., El Segundo, CA (US)

(72) Inventor: Marcel Santos, Orlando, FL (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/813,621

(22) Filed: Nov. 15, 2017

(65) Prior Publication Data

US 2019/0143231 A1 May 16, 2019

(51) Int. Cl.
*A63H 17/00* (2006.01)
*A63H 18/00* (2006.01)

(52) U.S. Cl.
CPC ..... *A63H 17/008* (2013.01); *A63H 18/00* (2013.01)

(58) Field of Classification Search
CPC .... A63H 17/008; A63H 18/00; A63H 18/028; A63H 27/14
USPC ..... 446/429, 430
See application file for complete search history.

(56) References Cited

U.S. PATENT DOCUMENTS 192,751 A 7/1877 Follett
1,318,708 A 10/1919 Turner
2,522,160 A 9/1950 Borchers
2,804,619 A * 8/1957 Holt ..... A63H 27/14 124/2
2,912,780 A 11/1959 Weimer
3,600,849 A 8/1971 Faller
3,693,282 A 9/1972 Adicks et al.
3,908,303 A * 9/1975 McKay ..... A63H 18/14 273/129 R
4,016,674 A * 4/1977 Resnick ..... A63H 17/262 446/409
4,464,860 A * 8/1984 Onodera ..... A63H 29/24 238/10 R
4,472,906 A 9/1984 Cook et al.
4,479,326 A * 10/1984 Kennedy ..... A63H 29/24 446/23
4,690,654 A 9/1987 DeLaney
4,732,569 A * 3/1988 Hippely ..... A63H 17/008 446/430
4,737,135 A 4/1988 Johnson et al.
5,052,973 A * 10/1991 Rudell ..... A63H 17/008 124/17
5,370,571 A 12/1994 Bosch
5,460,560 A * 10/1995 Liu ..... A63H 17/008 446/23

(Continued)

*Primary Examiner* — Vishu K Mendiratta
(74) *Attorney, Agent, or Firm* — Edell, Shapiro & Finnan, LLC

(57) ABSTRACT

A toy vehicle launcher has a housing, a handle, a slidable plate, a retention member, and biasing elements. The handle is moveably attached to the housing. The slidable plate is operatively coupled to the handle and movable with respect to the housing. The slidable plate includes sequential notches. The first biasing element couples the slidable plate to the housing. The first biasing element biases the slidable plate in a first direction with respect to the housing. Movement of the handle moves the slidable plate in a second direction against the bias of the first biasing element. The retention member is disposed proximate the slidable plate and configured to engage and disengage with notches. The second biasing element attaches the retention member to the launcher housing. The second biasing element biases the retention member into contact with the slidable plate.

20 Claims, 16 Drawing Sheets

(56) References Cited

U.S. PATENT DOCUMENTS

| | | | | |
|---|---|---|---|---|
| 5,522,752 | A * | 6/1996 | Liu | A63H 17/008 446/22 |
| 5,643,040 | A * | 7/1997 | Hippely | A63H 18/00 446/423 |
| 5,674,105 | A | 10/1997 | Hamlin | |
| 6,435,929 | B1 * | 8/2002 | Halford | A63H 17/02 273/108.53 |
| 7,077,117 | B1 | 7/2006 | Chu | |
| 8,302,588 | B2 | 11/2012 | Chen | |
| 8,322,660 | B2 | 12/2012 | O'Connor | |
| 9,200,864 | B2 | 12/2015 | Lin | |
| 9,347,735 | B2 | 5/2016 | Falkowski, II et al. | |
| 9,387,410 | B1 | 7/2016 | Tao et al. | |
| 9,427,671 | B2 * | 8/2016 | O'Connor | A63H 17/008 |
| 2011/0263179 | A1 | 10/2011 | Martino | |
| 2014/0051326 | A1 * | 2/2014 | Nuttall | A63H 18/02 446/446 |
| 2016/0038844 | A1 | 2/2016 | Bashaw et al. | |
| 2016/0263487 | A1 | 9/2016 | Tao et al. | |

* cited by examiner

TOY VEHICLE LAUNCHER

FIELD OF THE INVENTION

The present invention relates to a toy vehicle playset, and more specifically, a toy vehicle playset that includes an incremental launcher.

BACKGROUND OF THE INVENTION

Toy vehicle playsets are used to increase the play patterns and play longevity of toy vehicles. Some toy vehicle playsets include launchers that enable the user to launch a toy vehicle along the playset or from the playset (e.g., preferably along a track coupled to the playset). However, these launchers are typically only capable of launching the toy vehicle at a set speed, limiting the ability of the user to select a desired launching power or speed of the toy vehicle. Furthermore, these conventional launchers also fail to contain any other interactive features that are linked or associated with the launching mechanism and that further enhance the play patterns of the playset.

Therefore, it is desirable to provide a toy vehicle playset with an incremental launching mechanism that enables a user to repeatedly pump or ratchet a lever of the launch mechanism until the launch mechanism launches a toy vehicle. Furthermore, is it also desirable to provide a toy vehicle playset with an incremental launching mechanism that enables the user to set the desired launching power or speed of the toy vehicle. It is further desirable to provide a toy vehicle playset with a launcher that contains other interactive features that are linked with the launching of the toy vehicle to further enhance the play patterns of the launcher and playset.

SUMMARY OF THE INVENTION

The present invention is directed toward a toy vehicle launcher having a launcher housing, a handle, a slidable plate, a retention member, an impactor, and first and second biasing elements. The handle may be moveably attached to the launcher housing. Additionally, the slidable plate may be operatively coupled to the handle and movable with respect to the launcher housing. The slidable plate may also include a first notch and a second notch displaced from the first notch. The first biasing element may couple the slidable plate to the launcher housing. Furthermore, the first biasing element may bias the slidable plate in a first direction with respect to the launcher housing. Moreover, movement of the handle moves the slidable plate in a second direction against the bias of the first biasing element. The retention member may be disposed proximate to the slidable plate and configured to engage and disengage with the first notch and the second notch. In addition, the second biasing element may attach the retention member to the launcher housing. The second biasing element may bias the retention member into contact with the slidable plate. Finally, the impactor may be attach to the slidable plate.

In another embodiment, the present invention is directed toward a toy vehicle launcher having a launcher housing, a handle, a slidable plate, a retention member, an impactor, and first and second biasing elements. The handle may be rotatably attached to the launcher housing. Furthermore, the slidable plate may be operatively coupled to the handle and incrementally movable with respect to the launcher housing via successive rotations of the handle. The slidable plate may include a plurality of sequential primary notches. The first biasing element may couple the slidable plate to the launcher housing. Additionally, the first biasing element may bias the slidable plate in a first direction with respect to the launcher housing. Successive rotations of the handle may translate the slidable plate in increments along a second direction against the bias of the first biasing element. The retention member may be disposed proximate the slidable plate and configured to engage and disengage with the plurality of primary notches. The second biasing element may attach the retention member to the launcher housing and may bias the retention member into engagement with one of the plurality of primary notches. Finally, the impactor may be coupled to the slidable plate.

In yet another embodiment, the present invention is directed toward a toy vehicle launcher having a launcher housing, a handle, a slidable plate, a retention member, and first and second biasing members. The handle may be rotatably coupled to the launcher housing such that the handle is configured to rotate about the housing a first amount and a second amount. The slidable plate may be disposed within the housing and operatively coupled to the handle. The slidable plate may be configured to move with respect to the housing in successive increments as the handle is successively rotated the first amount. Furthermore, the slidable plate may include a plurality of sequential notches. The first biasing element may couple to the slidable plate to the launcher housing. The first biasing element may bias the slidable plate in a first direction with respect to the launcher housing. Moreover, successive rotations of the handle the first amount may translates the slidable plate in increments along a second direction against the bias of the first biasing element. The retention member may be disposed proximate to the slidable plate and may be configured to engage and disengage with the plurality of notches of the slidable plate. The second biasing element attaches the retention member to the launcher housing. Moreover, the second biasing element biases the retention member into engagement with one of the plurality of notches. Furthermore, rotation of the handle the second amount disengages the retention member from the plurality of notches and enables the first biasing element to translate the slidable plate along the first direction. The launcher housing may further include an impactor coupled to the slidable plate.

BRIEF DESCRIPTION OF THE DRAWINGS

Like reference numerals have been used to identify like elements throughout this disclosure.

DETAILED DESCRIPTION OF THE INVENTION

The present invention relates to toy vehicle playset that includes an incremental toy vehicle launcher disposed on or within the toy vehicle playset and configured to launch a toy vehicle from or around the toy vehicle playset. The launch speed or power may be incrementally set by a user prior to launching the toy vehicle. In one embodiment, the user may repeatedly pull/pump/actuate a lever/actuator to set the launch mechanism prior to launching the toy vehicle. More specifically, as the lever/actuator of the toy vehicle launcher is repeatedly pulled/pumped/actuated, the potential energy of the launcher increases until the lever/actuator/handle is placed into a launch position that ultimately launches a toy vehicle. For example, the more a lever is pulled prior to launching the toy vehicle, the farther a toy vehicle will travel. Conversely, the less a lever is pulled prior to launching the toy vehicle, the shorter the distance the vehicle will travel when launched. Furthermore, the lever and the playset may resemble another item, such as, but not limited to, an automotive themed item (e.g., a gas station pump). Repeated actuation of the lever may, in addition to building the amount of potential energy in the launching mechanism, activate other features on the playset (e.g., movement of a fuel pump capacity indicator). Thus, the toy vehicle launcher playset is configured to provide unique play patterns for a user while simultaneously enabling the user to incrementally set the launch power amount of the launch mechanism.

Figure 1A:
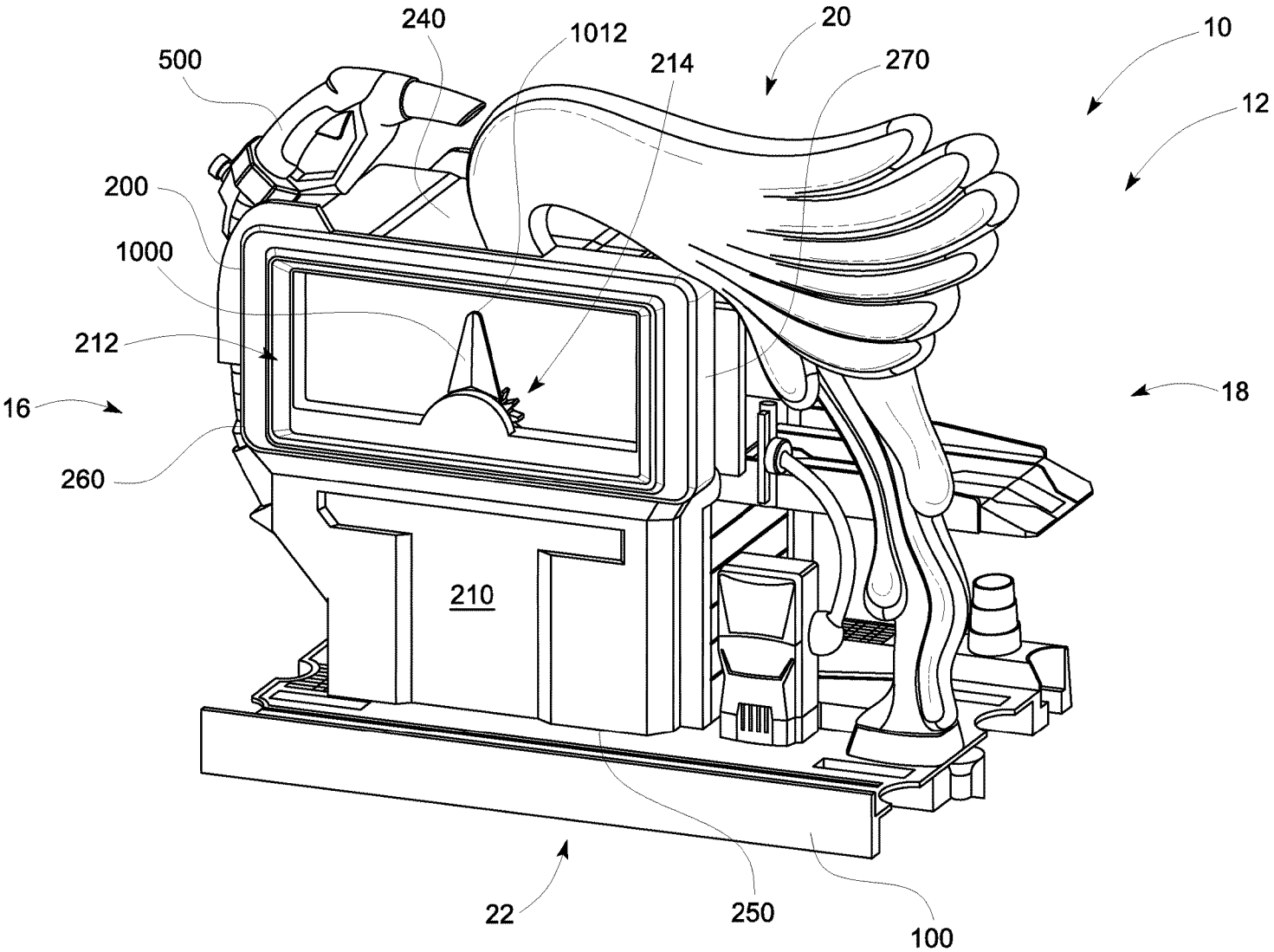
FIG. 1A illustrates a front perspective view of an embodiment of a toy vehicle launcher playset according to the present invention.
Figure 1B:
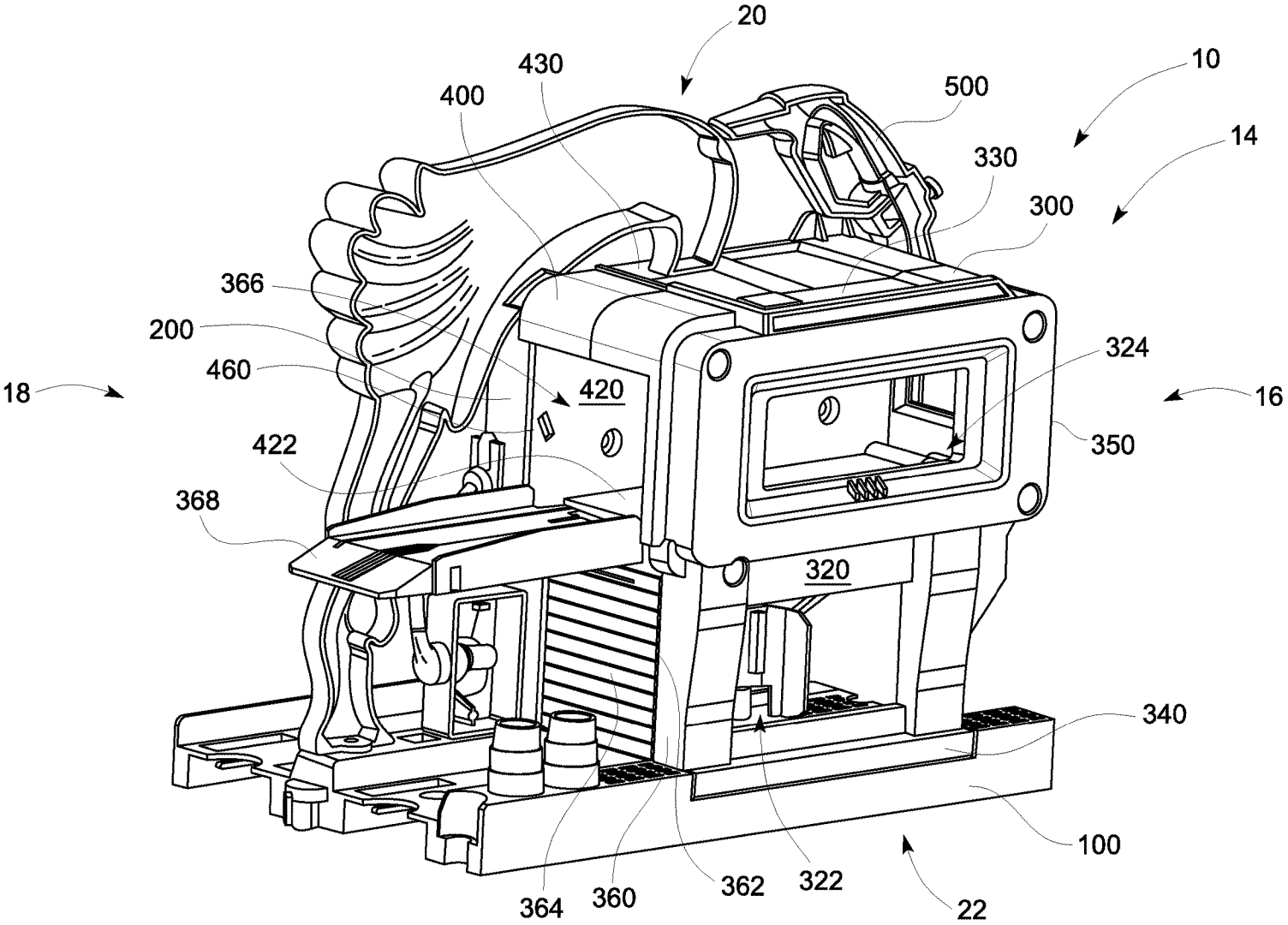
FIG. 1B illustrates a rear perspective view of the embodiment of the toy vehicle launcher playset illustrated in FIG. 1A.
Figure 1C:
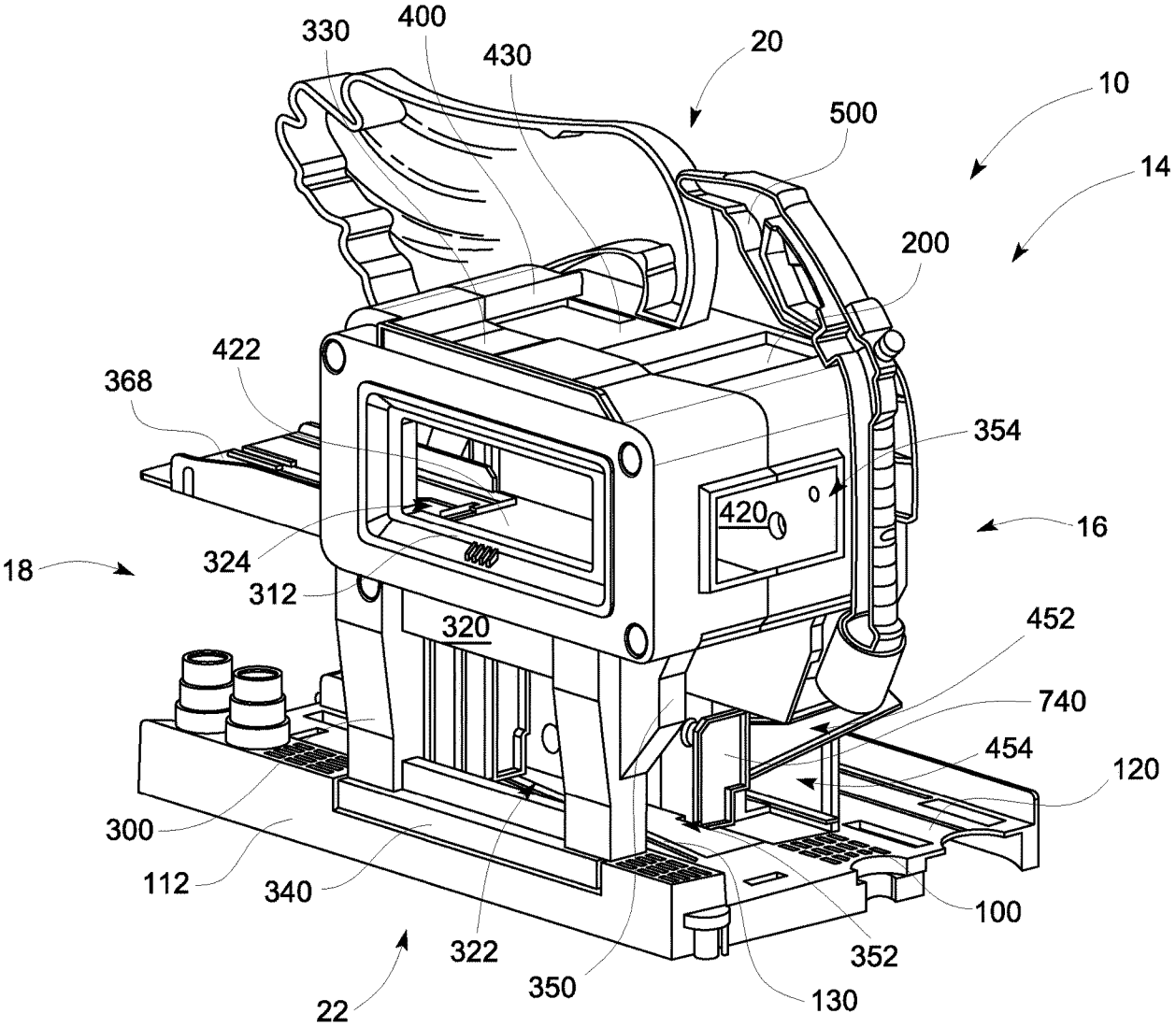
FIG. 1C illustrates another rear perspective view of the embodiment of the toy vehicle launcher playset illustrated in FIG. 1A.

With general reference to FIGS. 1A, 1B, and 1C, illustrated is an embodiment of a toy vehicle launcher playset 10. The playset 10 includes a front side 12 (illustrated in FIG. 1A), an opposite rear side 14 (illustrated in FIGS. 1B and 1C), a first side 16, and a second side 18 opposite the first side 16. The playset 10 further includes a top side 20 and a bottom side 22 opposite the top side 20. As further illustrated, the playset 10 includes a base 100, a front housing cover 200, a rear housing cover 300, and an intermediate housing cover 400. The front, rear, and intermediate housing covers 200, 300, 400 are disposed on the base 100, and, as further detailed below, are configured to encapsulate the launch mechanism 600. The embodiment of the playset 10 illustrated in FIGS. 1A, 1B, and 1C is configured to resemble a gas pump.

Figure 2:
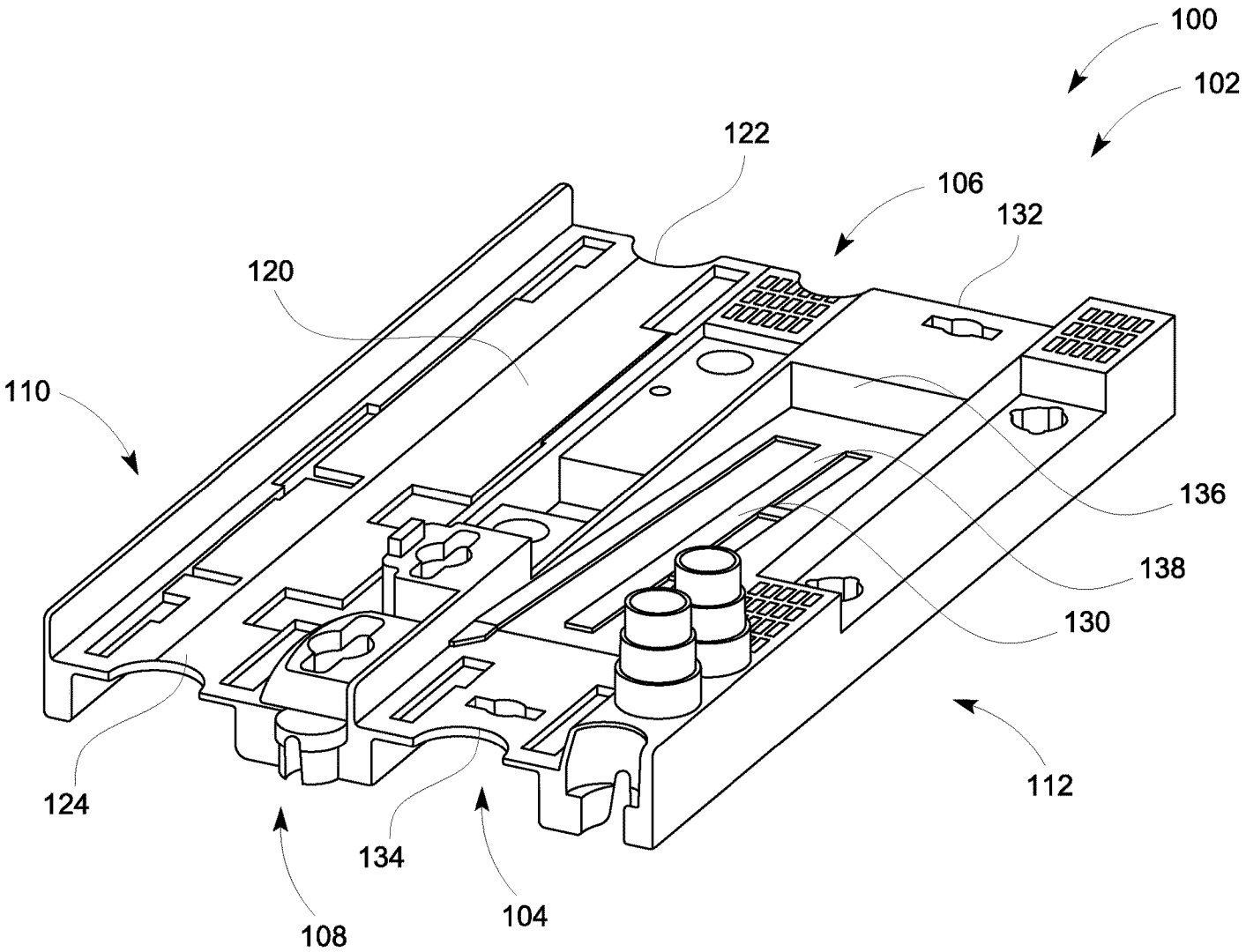
FIG. 2 illustrates a perspective view of the base of the embodiment of the toy vehicle launcher playset illustrated in FIG. 1A where the play features are removed from the support platform of the infant support.

Turning to FIG. 2, illustrated is a perspective view of the base 100. As illustrated, the base 100 is substantially rectangular with a top side 102, an opposite bottom side 104, a first side 106, and a second side 108 opposite the first side 106. The base 100 further includes a front side 110 and an opposite rear side 112. In the embodiment illustrated, the base 100 also includes a first track 120 and a second track 130 disposed within the top side 102 of the base 100. The first and second tracks 120, 130 may be substantially parallel to one another, with the first track 120 being disposed more proximate to the front side 110, and the second track 130 being disposed more proximate to the rear side 112. The first track 120 includes a first end 122 disposed proximate to the first side 106 of the base 100, and a second end 124 disposed proximate to the second side 108 of the base 100. Thus, the first track 120 spans across the top side 102 of the base 100 from the first side 106 to the second side 108 proximate to the front side 110. Similar to the first track 120, the second track 130 includes a first end 132 disposed proximate to the first side 106 of the base 100, and a second end 134 disposed proximate to the second side 108 of the base 100. The second track 130 further includes a ledge or partition wall 136 disposed proximate to the first end 132 of the second track 130. As further illustrated, the second track 130 also includes an inclined portion 138, which has its lowest end proximate to the ledge 136, and its highest end proximate to the second end 134 of the second track 130. Thus, as illustrated, the second track 130 spans across the top side 102 of the base 100 from the first side 106 to the second side 108 proximate to the rear side 112, where the second track 130 drops in height at the ledge 136 and contains an incline from the ledge 136 to the second end 134.

Figure 3A:
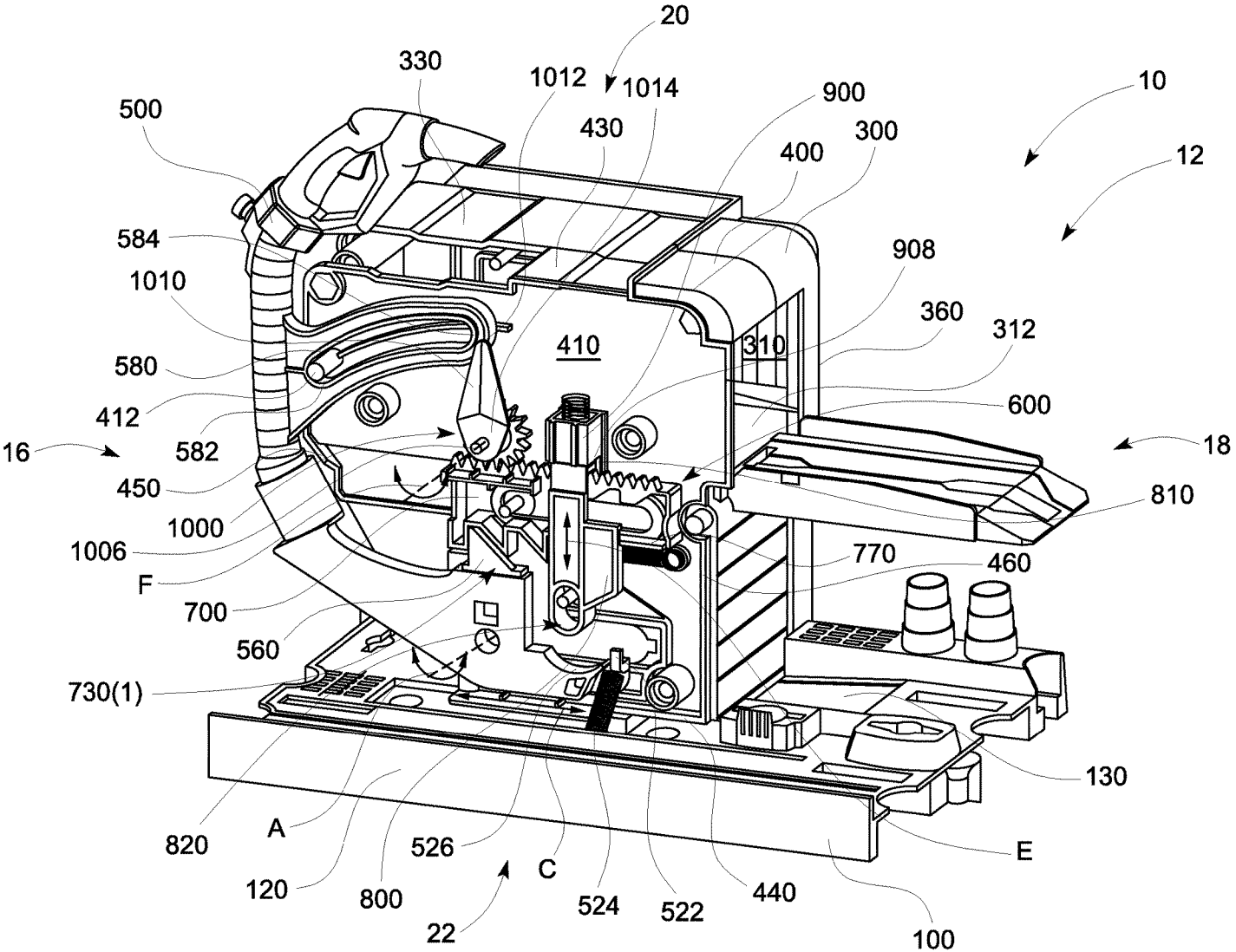
FIG. 3A illustrates a front perspective view of the launch mechanism coupled to the intermediate housing cover of the embodiment of the toy vehicle launcher playset illustrated in FIG. 1A.
Figure 3B:
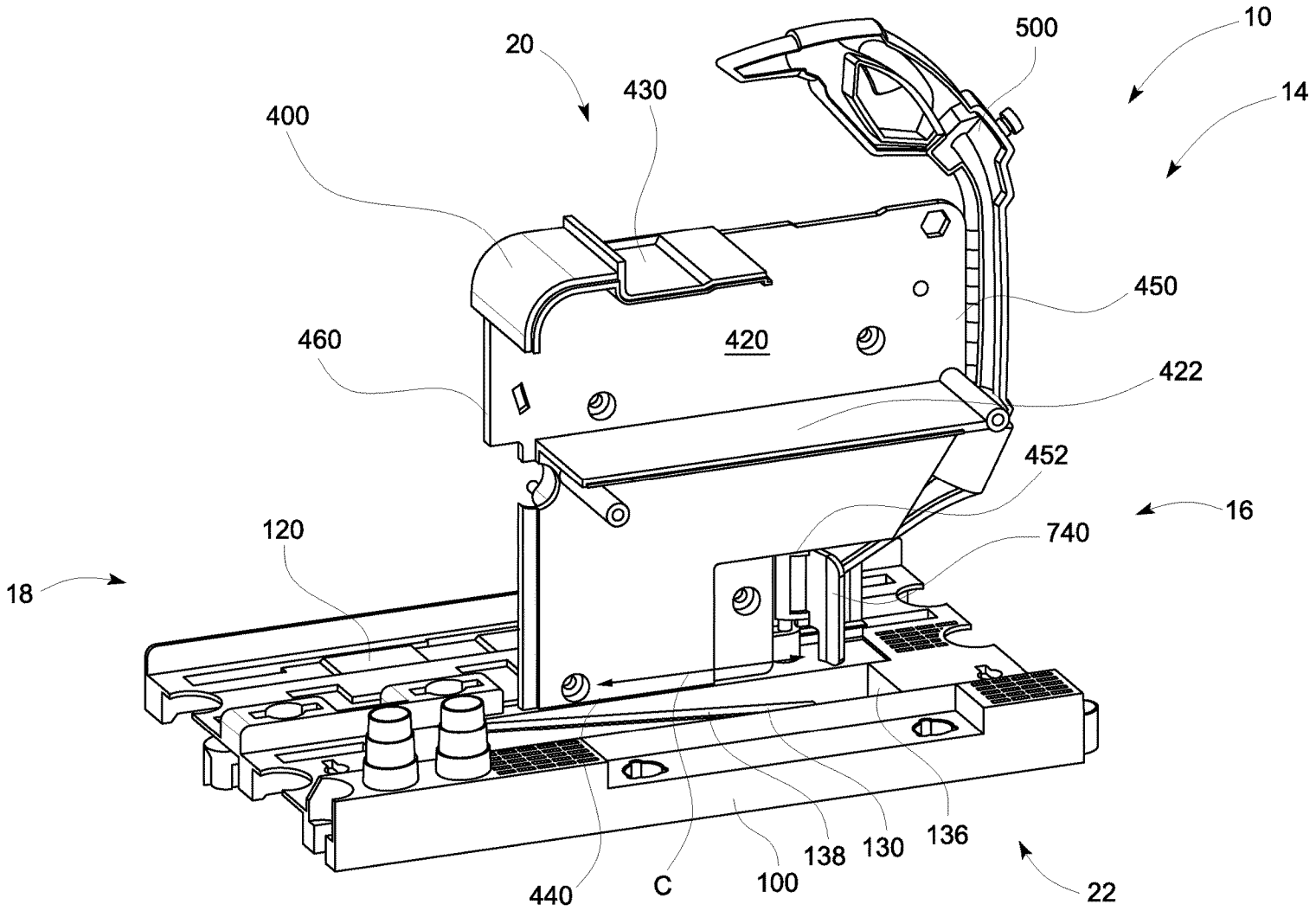
FIG. 3B illustrates a rear perspective view of the launch mechanism coupled to the intermediate housing cover of the embodiment of the toy vehicle launcher playset illustrated in FIG. 1A.
Figure 3C:
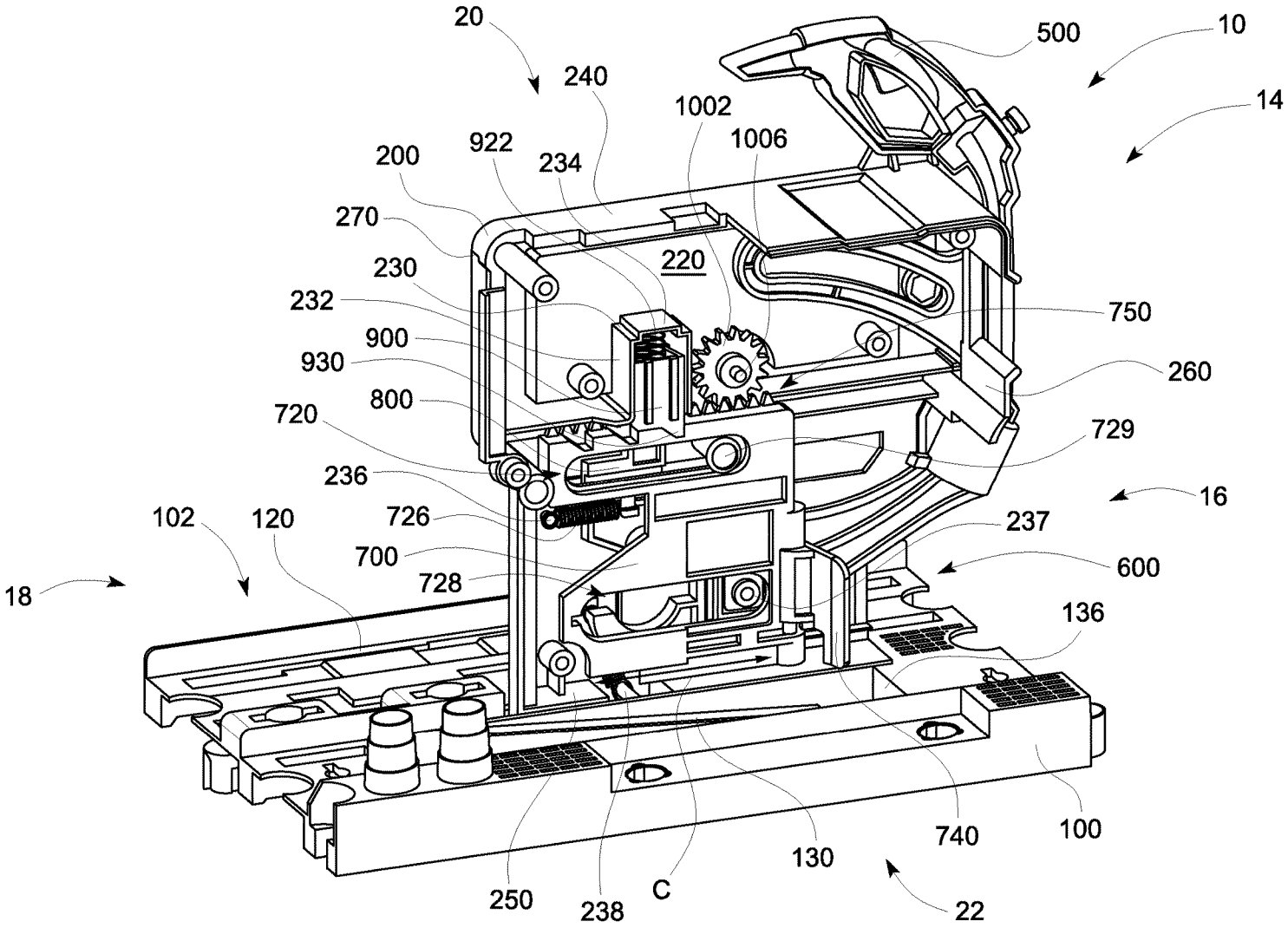
FIG. 3C illustrates a rear perspective view of the launch mechanism coupled to the front housing cover of the embodiment of the toy vehicle launcher playset illustrated in FIG. 1A.
Figure 3D:
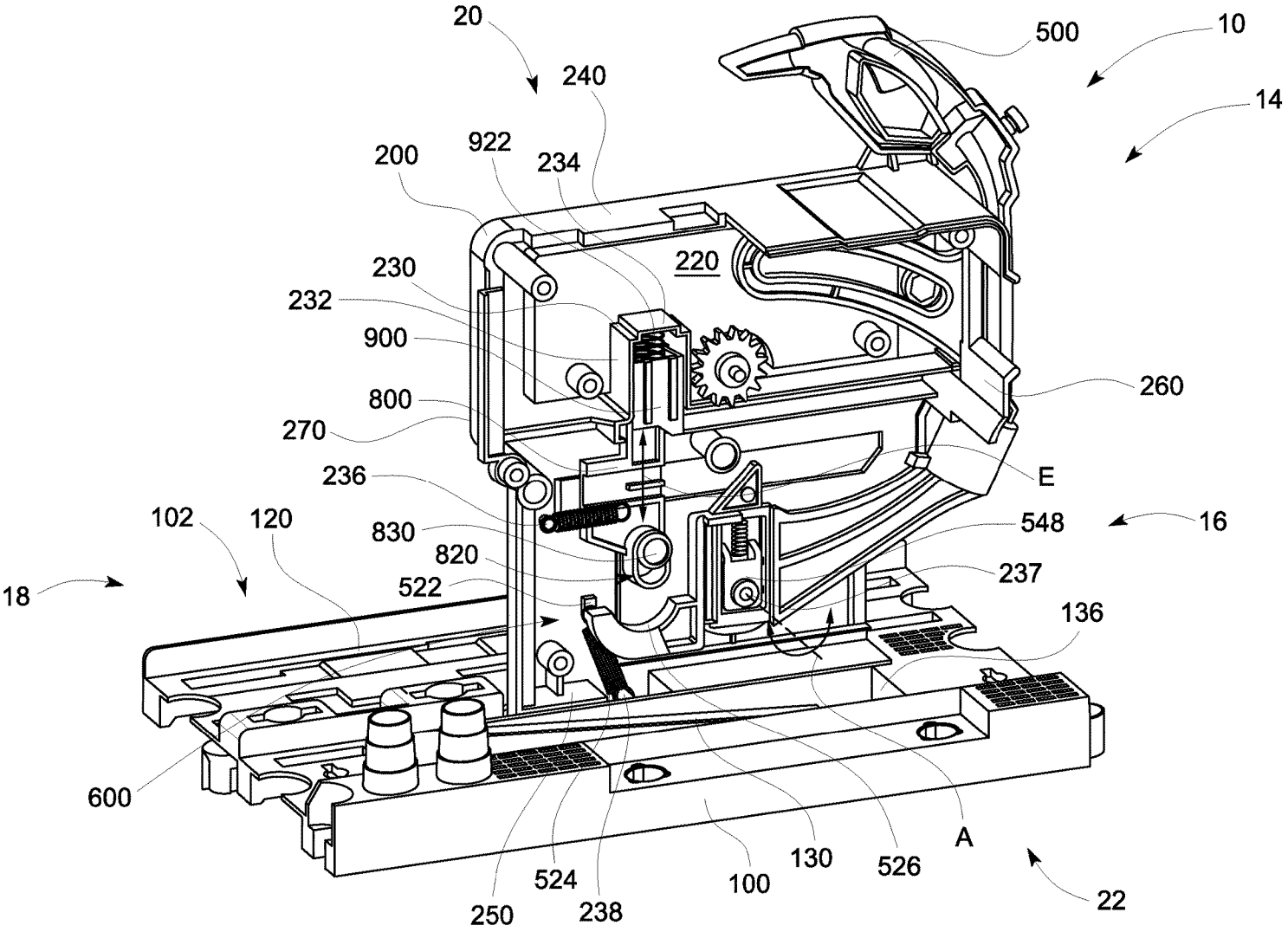
FIG. 3D illustrates another rear perspective view of the launch mechanism coupled to the front housing cover of the embodiment of the toy vehicle launcher playset illustrated in FIG. 1A.

As best illustrated in FIGS. 1A, 3C, and 3D, the front housing cover 200 is disposed on the top surface 102 of the base 100 between the first track 120 and the second track 130. As illustrated, the front housing cover 200 includes a front or exterior side 210, an opposite rear or interior side 220, a top side 240, a bottom side 250 opposite the top side 240, a first side 260, and a second side 270 opposite the first side 260. The bottom side 250 of the front housing cover 200 is disposed on the top side 102 of the base 100 such that the front housing cover 200 extends upwardly in a substantially vertical direction from the top side 102 of the base 100 between the first track 120 and the second track 130. As further illustrated, the first side 260 of the front housing cover 200 is disposed proximate to the ledge 136 of the second track 130. For the illustrated embodiment of the front housing cover 200, the front side 210 resembles the front of a gas station pump. The front side 210 includes a display 212 proximate to the top side 240, where the display 212 includes a slot 214. As will be further explained below, a dial 1000 extends through the slot 214 and is movable through the display 212.

As best illustrated in FIGS. 3C and 3D, the rear side 220 of the front housing cover 200 is operatively coupled to the launch mechanism 600. The rear side 220 of the front housing cover 200 includes a cavity 230 centrally disposed on the rear side 220. The cavity 230 includes a pair of sidewalls 232 coupled to a top wall 234. The sidewalls 232 and the top wall 234 collectively define the cavity 230 that is configured to slidably receive the retention member 900 of the mechanism 600, as explained in more detail below. The rear side 220 of the front housing cover 200 further includes a series of pillars 236, 237, 238 that extend substantially perpendicular or transverse from the surface of the rear side 200. As further detailed below, pillars 236 and 238 are configured to be coupled to resilient members of the launch mechanism 600, while the lever or handle 500 of the playset 10 is rotatably coupled to pillar 237.

As best illustrated in FIGS. 1B, 1C, 3A, and 3B, the intermediate housing cover 400 is coupled to the base 100 and the rear side 220 of the front housing cover 200. As illustrated, the intermediate housing cover 400 includes a front side 410, an opposite rear side 420, a top side 430, a bottom side 440 opposite the top side 430, a first side 450, and a second side 460 opposite the first side 450. The bottom side 440 of the intermediate housing cover 400 is disposed on the top side 102 of the base 100 such that the intermediate housing cover 400 extends upwardly in a substantially vertical direction from the top side 102 of the base 100 between the first track 120 and the second track 130. Moreover, the front side 410 of the intermediate housing cover 400 may be coupled to the rear side 220 of the front housing cover 200.

As best illustrated in FIG. 3A, the front side 410 of the intermediate housing cover 400 includes a guide post 412 that extends substantially perpendicular from the surface of the front side 410. The guide post 412 may be disposed proximate to the top side 430 and the first side 450. As further detailed below, the guide post 412 may be configured to guide or limit the rotational movement for the lever 500, as the guide post 412 is operatively received by a portion of the lever 500.

As further illustrated, the intermediate housing cover 400 contains a cutaway portion 452 disposed proximate to the first side 450 and the bottom side 440 of the intermediate housing cover 400. When coupled to the base 100, the cutaway portion 452 is disposed proximate to the ledge 136 of the second track 130. As best illustrated in FIG. 3B, and as explained in further detail below, a contact plate 740 extends through the cutaway portion 452, from the front side 410 to the rear side 420, to be disposed over the second track 130 proximate to the ledge 136. Furthermore, as best illustrated in FIG. 1C, the cutaway portion 452 may at least partially form a slot 454 with the front housing cover 200, where the lever 500 may be configured to move through the slot 454 when actuated or pumped.

In addition, the intermediate housing cover 400 also contains a platform 422 that extends perpendicularly from the surface of the rear side 420 of the intermediate housing cover 400. As illustrated, the platform 422 may be disposed between the top side 430 and the bottom side 440 of the intermediate housing cover 400, while spanning from the first side 450 to the second side 460 across the rear side 420.

As best illustrated in FIGS. 1B, 1C, and 3A, the rear housing cover 300 is coupled to the base 100 and the rear side 420 of the intermediate housing cover 400. As illustrated, the rear housing cover 300 includes a front side 310, an opposite rear side 320, a top side 330, a bottom side 340 opposite the top side 330, a first side 350, and a second side 360 opposite the first side 350. The bottom side 340 of the rear housing cover 300 is disposed on the top side 102 of the base 100 proximate to the rear side 112 of the base 100. The front side 310 of the rear housing cover 300 may be coupled to the rear side 210 of the intermediate housing cover 300 such that the rear housing cover 300 extends over the second track 130.

As best illustrated in FIGS. 1C and 3A, the rear housing cover 300 contains a platform 312 that extends perpendicularly from the surface of the front side 310 of the rear housing cover 300. Similar to the platform 422 of the intermediate housing cover 400, the platform 312 may be disposed between the top side 330 and the bottom side 340 of the rear housing cover 300, while spanning from the first side 350 to the second side 360 across the front side 310. The platform 422 of the intermediate housing cover 400 may be configured to couple to the platform 312 of the rear housing cover 300 to collectively form a single platform capable of supporting one or more toy vehicles. Moreover, the platform 422 of the intermediate housing cover 400 may be couple to the platform 312 of the rear housing cover 300 over the second track 130.

The rear housing cover 300 further includes a lower window 322 and an upper window 324 that extend through rear housing cover 300 from the rear side 320 to the front side 310. The lower window 322 may be disposed lower in height than the platform 312, while the upper window 324 may be disposed higher in height than the platform 312.

In addition, the rear housing cover 300 also includes a first lower passage 352 formed in the first side 350 of the rear housing cover 300. The lower passage 352 is aligned over the second track 130 and configured to enable a toy vehicle to travel along the second track 130 of the base 100. The rear housing cover 300 further includes a second lower passage 362 disposed on the second side 360 opposite of the first lower passage 352. Thus, the second lower opening 362 is also disposed over the second track 130, and is also configured to enable a toy vehicle to travel along the second track 130 of the base 100. As further illustrated, a swing door 364 may be disposed over or within the second lower opening 362. This swing door 364 may be configured to freely swing open and swing closed (e.g., as a toy vehicle travels along the second track 130 through the second lower passage 362).

The rear housing cover 300 further includes an upper window 354 disposed in the first side 350. The upper window 354 may be collectively formed with a portion of the first side 260 of the front housing cover 200. Furthermore, the upper window 354 may be disposed higher in height than the platform 312 of the rear housing cover 300. Opposite the upper window 354 is an upper passage 366 that is disposed in the second side 360 of the rear housing cover 300. The upper passage 366 may be aligned with the platform 312 of the rear housing cover 300 and the platform 422 of the intermediate housing cover 400 to enable a toy vehicle to travel onto and off of the platforms 312, 422 through the upper passage 366. Moreover, a ramp 368 may be rotatably coupled to the second side 360 of the rear housing cover 300 proximate to the platforms 312, 422 and the upper passage 366.

Returning to FIGS. 1A, 1B, and 1C, the front side 210 of the front housing cover 200 primarily forms the front side 12 of the playset 10, while the rear side 320 of the rear housing cover 300 primarily forms the rear side 14 of the playset 10. The first side 16 of the playset is collectively formed from the first sides 260, 350, 450 of the front, rear, and intermediate housings 200, 300, 400, respectively, while the second side 18 of the playset is collectively formed from the second sides 270, 360, 460 of the front, rear, and intermediate housings 200, 300, 400, respectively. Furthermore, the top side 20 of the playset 10 is collectively formed from the top sides 240, 330, 430 of the front, rear, and intermediate housings 200, 300, 400, respectively, while the bottom side 22 of the playset is formed from the bottom side 104 of the base 100.

Figure 4A:
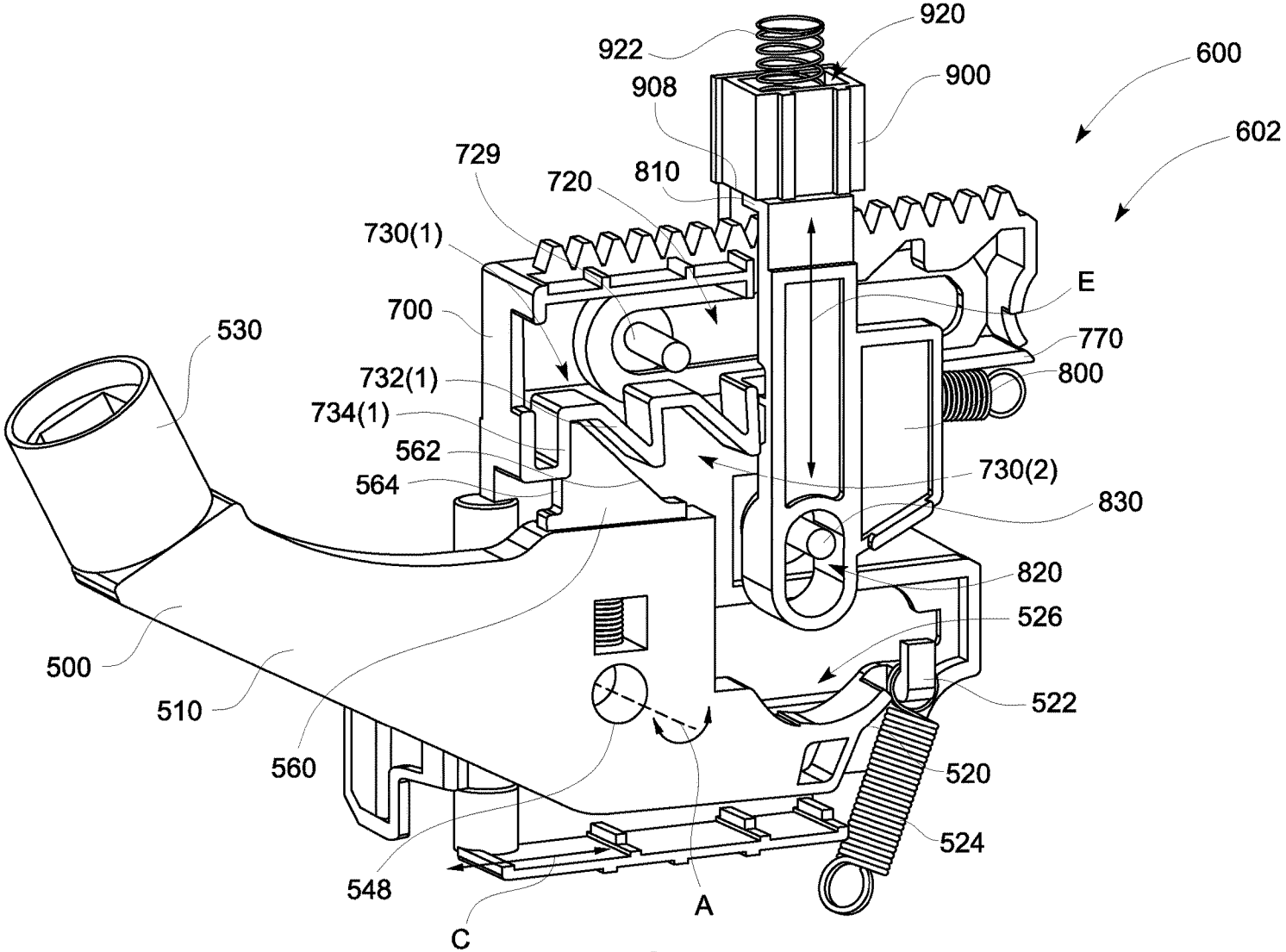
FIG. 4A illustrates an isolated front perspective view of the launch mechanism of the embodiment of the toy vehicle launcher playset illustrated in FIG. 1A.
Figure 4B:
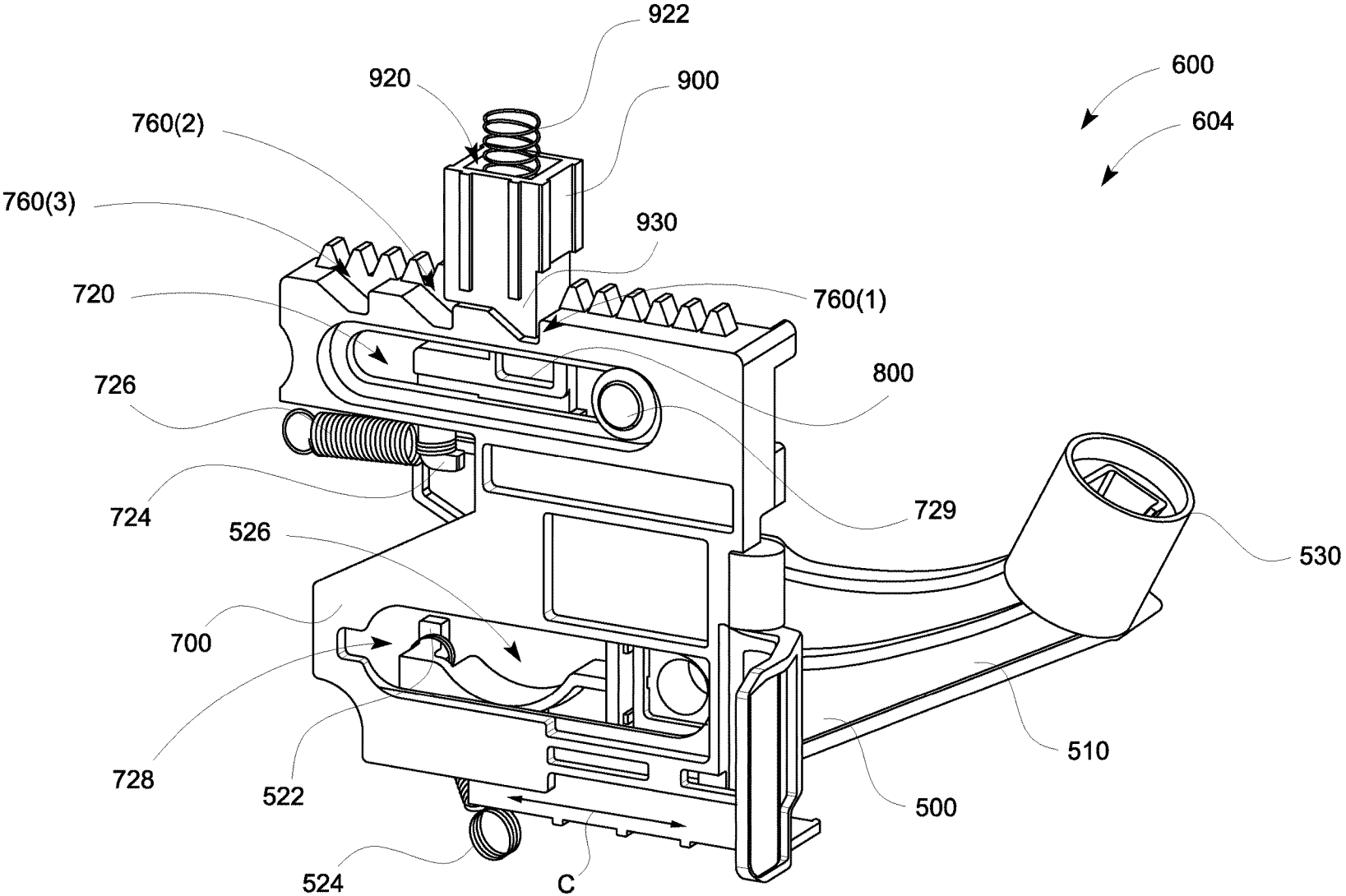
FIG. 4B illustrates an isolated rear perspective view of the launch mechanism illustrated in FIG. 4A.

Turning to FIGS. 3A, 3B, 3C, 3D, 4A, and 4B, illustrated is the launch mechanism 600. As briefly explained above, the launch mechanism 600 is operatively coupled to the lever 500 such that a user pulling or pumping the lever 500 can load and actuate the launch mechanism 600 to launch a toy vehicle along the second track 130 of the base 100. As illustrated in FIGS. 4A and 4B, the launch mechanism 600 includes a front side 602 and a rear side 604. Furthermore, as illustrated in FIGS. 3A, 3B, 3C, and 3D, the launch mechanism 600 is disposed in the playset 10 primarily between the front housing cover 200 and the intermediate housing cover 400. As further illustrated, the lever 500, which is operatively coupled to the launch mechanism 600 extends through the slot 454 formed collectively of the intermediate housing cover 400 and the front housing cover 200 to operatively couple to the launch mechanism 600. As illustrated, the launch mechanism 600 includes a sliding plate 700, an elongate member 800, a retention member 900, and a dial 1000 that operate with respect to one another to launch a toy vehicle along the second track 130 and/or from the playset 10.

Figure 5A:
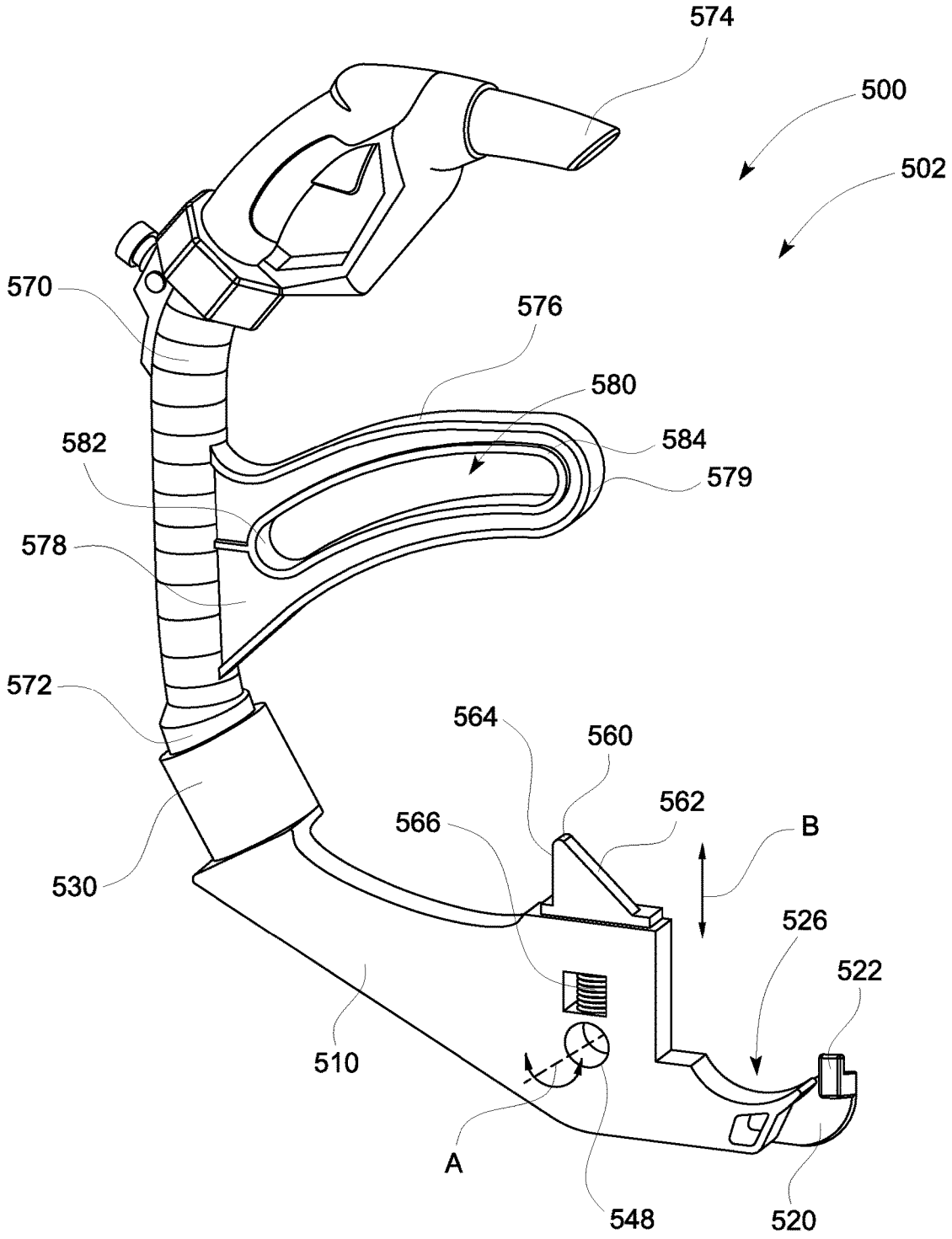
FIG. 5A illustrates a front elevational view of the lever of the embodiment of the toy vehicle launcher playset illustrated in FIG. 1A.
Figure 5B:
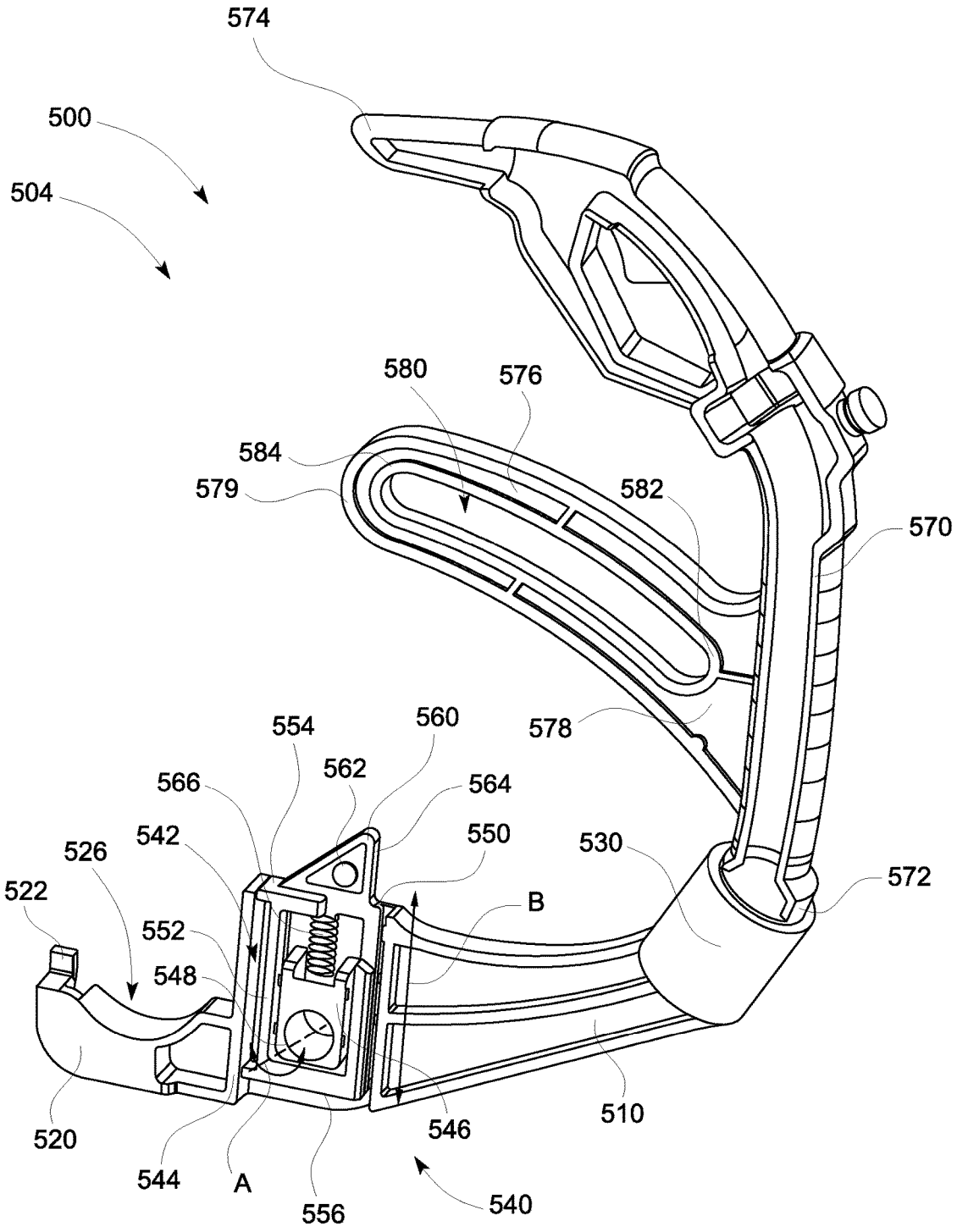
FIG. 5B illustrates a rear elevational view of the lever illustrated in FIG. 5A.

Turning to FIGS. 5A and 5B, illustrated are isolated views of the lever 500. The front side 502 of the lever 500 is illustrated in FIG. 5A, while the rear side 504 of the lever 500 is illustrated in FIG. 5B. In the embodiment illustrated, the lever 500 includes a first or lower portion 510, and a second or upper portion 570. The lower portion 510 is substantially curved or arcuate, and includes a first end 520 and a second end 530. The upper portion 570 is also curved or arcuate, and also includes a first end 572 and a second end 574. The first end 572 of the upper portion 570 is coupled to, and received by, the second end 530 of the lower portion 510.

As best illustrated in FIG. 5B, the lower portion 510 of the lever 500 includes a receiving portion 540 that is disposed between the first end 520 and the second end 530 of the lower portion 510. The receiving portion 540 includes a partially enclosed passage 542 that extends substantially vertically through the lower portion 510. The passage 542 includes a set of sidewalls 544 that defines the passage 542 by enclosing the passage 542 along three sides of the passage 542. Moreover, disposed within the passage 542 is an intermediate wall 546. Disposed through the intermediate wall 546 and the lower portion 510 is an aperture 548 that is configured to receive pillar 237 of the rear side 220 of the front housing cover 200, as illustrated in FIGS. 3C and 3D. The lever 500 is configured to rotate about axis A that extends concentrically through the pillar 237 and the aperture 548. Thus, the lever 500 is configured to rotate about the second pillar 237 of the rear side 220 of the front housing cover 200 from an original position, where the upper portion 570 of the lever 500 is disposed proximate to the first side 260 of the front housing cover 200, to an actuated position, where the upper portion 570 of the lever 500 is disposed away from the first side 260 of the front housing cover 200.

Moreover, as best illustrated in FIG. 5B, the passage 542 of the receiving portion 540 is configured to slidably receive a sliding toothed member 550 that is configured to slide along plane B through the passage 542. The sliding toothed member 550 includes a first end 554, an opposite second end 556, and a cavity 552 disposed between the two ends 554, 556. As illustrated, the intermediate wall 546 is received by the cavity 552 of the sliding toothed member 550. The sliding toothed member 550 further includes a tooth 560 that extends outwardly from the first end 554 of the sliding toothed member 550. The tooth 560 is substantially triangular in shape, and contains an inclined surface 562 and a substantially vertical surface 564. As further illustrated, a resilient member 566 is disposed through the cavity 552 of the sliding toothed member 550 between the first end 554 and the intermediate wall 546. The resilient member 566 biases the sliding toothed member 550 to the illustrated position, where the first end 554 is spaced from the intermediate wall 546, the second end 556 abuts the intermediate wall 546, and the tooth 560 extends from the passage 542. However, when downward pressure is applied to the tooth 560, the sliding toothed member 550 is capable of sliding through the passage 542, along plane B, such that the first end 554 abuts the intermediate wall 546, the resilient member 566 is compressed, and the second end 556 is spaced from the intermediate wall 546.

As further illustrated in FIGS. 5A and 5B, the upper portion 570 includes a curved or arcuate extension 576 that extends from the upper portion 570 over the lower portion 510. The curved extension 576 includes a first end 578 and an opposite second end 579. The first end 578 of the curved extension 576 is coupled to the upper portion 570 between the first and second ends 572, 574 of the upper portion 570, and the second end 579 of the curved extension 576 is suspended from the upper portion 570 of the lever 500. Disposed within the curved extension 576 is a guide track or slot 580. The guide track 580 includes a first end 582 disposed proximate to the first end 578 of the curved extension 576 and a second end 584 disposed proximate to the second end 579 of the curved extension 576. As best illustrated in FIG. 3A, the guide track 580 is configured to receive the guide post 412 of the front side 410 of the intermediate housing cover 400. Thus, the guide post 412 and the guide track 580 operate cooperatively to guide the upper portion 570 of the lever 500 when the lever 500 is rotated about axis A.

Moreover, the first end 520 of the lower portion 510 of the lever 500 includes a protrusion 522. As best illustrated in FIGS. 3A, 3D, and 4A, coupled to the protrusion 522 is a resilient member 524, which is also coupled to the third pillar 238 of the rear side 220 of the front housing member 200. The resilient member 524 biases the lever 500 to the unactuated or original position illustrated in FIGS. 3A, 3D, and 4A, where the upper portion 570 of the lever 500 is disposed proximate to the first side 260 of the front housing cover 200 and the guide pillar 412 is disposed proximate to the first end 582 of the guide track 580. When the upper portion 570 of the lever 500 is pulled downwardly to the actuated position, such that the lever 500 rotates about axis A, the first end 520 of lower portion 510 of the lever 500 is rotated upwardly away from the base 100. This expands, extends, or stretches the resilient member 524. Once the lever 500 is released, the resilient member 524 causes the lever 500 to rotate about axis A in the opposite direction to return to the original unactuated position.

Additionally, the first end 520 of the lower portion 510 of the lever includes a contact portion 526. This contact portion 526 may be curved and, as explained in further detail below, is shaped to contact and/or interface with the elongate member 800.

Figure 6A:
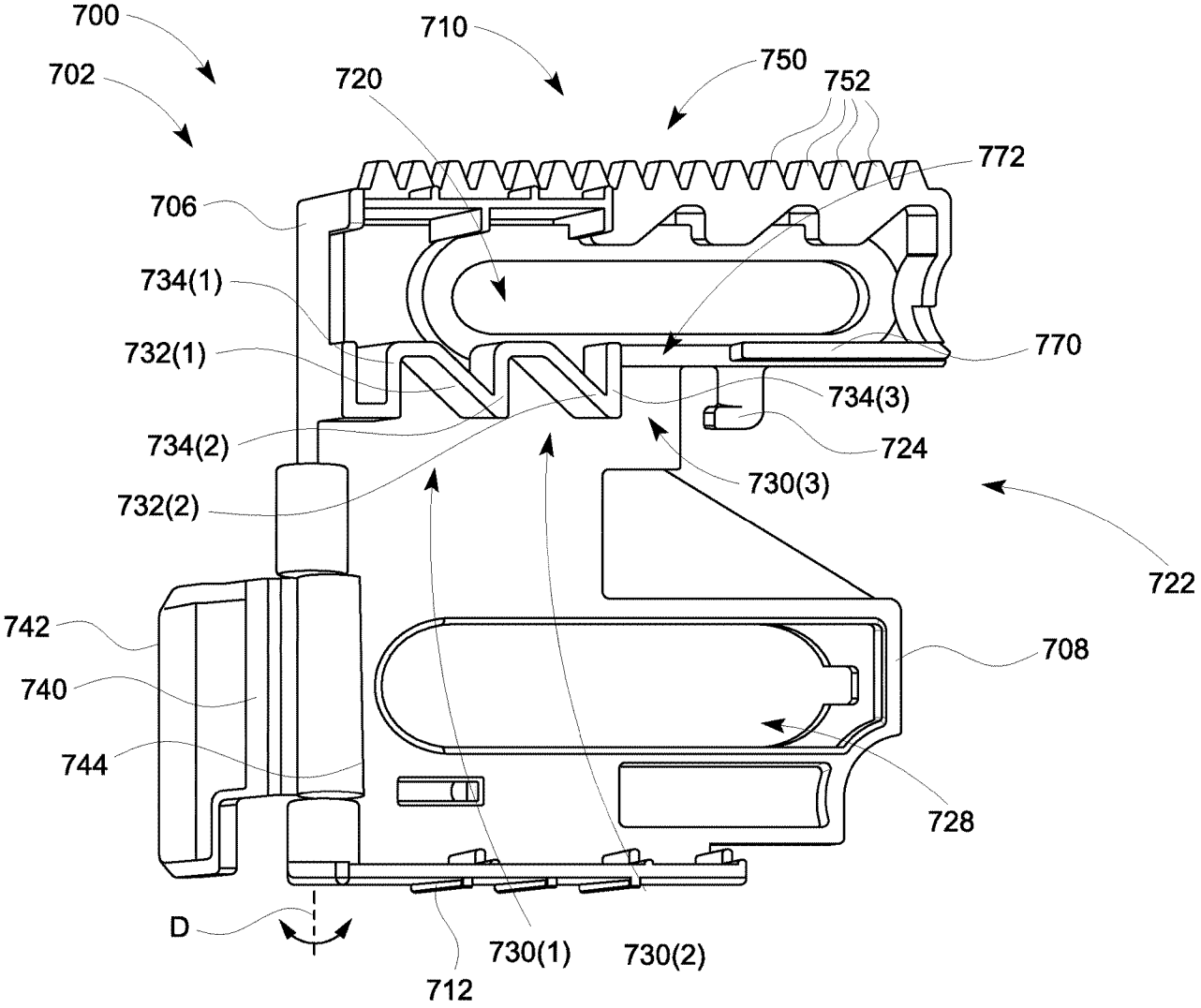
FIG. 6A illustrates a front elevational view of a sliding plate of the embodiment of the toy vehicle launcher playset illustrated in FIG. 1A.
Figure 6B:
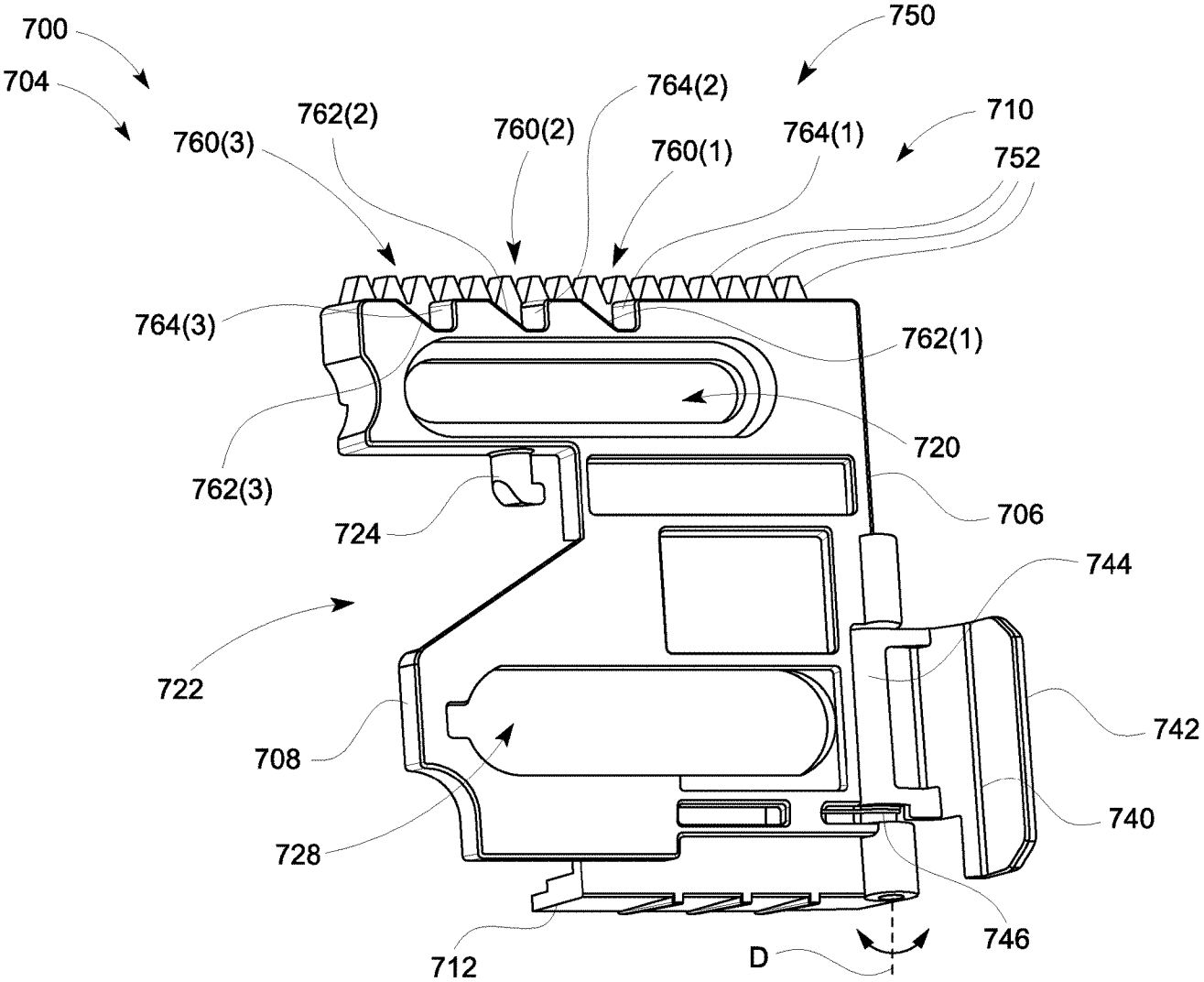
FIG. 6B illustrates a rear elevational view of the sliding plate illustrated in FIG. 6A.

Turning to FIGS. 6A and 6B, illustrated are isolated views of the sliding plate 700 of the launch mechanism 600. As illustrated, the sliding plate 700 includes a front side 702 (illustrated in FIG. 6A) and an opposite rear side 704 (illustrated in FIG. 6B). The sliding plate 700 further includes a first edge 706, an opposite second edge 708, a top edge 710, and a bottom edge 712 opposite the top edge 710. As illustrated, the sliding plate 700 is substantially planar. The sliding plate 700 includes an upper elongated slot 720 disposed through the front and rear sides 702, 704. The upper elongated slot 720 is disposed proximate to the top edge 710 of the sliding plate, and spans across a substantial portion of the sliding plate 700 from the first edge 706 to the second end 708. Similarly, the sliding plate 700 also includes a lower elongated slot 728 disposed through the front and rear sides 702, 704, and spans across a substantial portion of the sliding plate 700 from the first edge 706 to the second end 708. Unlike the upper elongated slot 720, the lower elongated slot 728 is disposed proximate to the bottom edge 712 of the sliding plate 700. The upper and lower elongated slots 720, 728 are substantially horizontal and parallel to one another. As best illustrated in FIG. 3C, a fastener (e.g., screw, pin, bolt, rivet, etc.) 729 is disposed through the upper elongated slot 720 to slidably secure the sliding plate 700 to the rear side 220 of the front housing cover 200. Moreover, FIG. 3C also illustrates that the second pillar 237 of the rear side 220 of the front housing cover 200 extends through the lower elongated slot 720 to be coupled to the front side 410 of the intermediate housing cover 400. The upper and lower elongated slots 720, 728 are approximately equal in length to enable the sliding plate 700 to slide along plane C between the released positioned, as illustrated in FIGS. 3A, 3C, 4A, and 4B, and a loaded position (not illustrated), where the fastener 729 and the second pillar 237 are disposed in various positions along the slots 720, 728, respectively, than those illustrated.

Returning to FIGS. 6A and 6B, the sliding plate 700 further includes a cutaway portion 722 disposed proximate to the second end 708 of the sliding plate 700 and extending through the first and second sides 702, 704. As illustrated, the cutaway portion 722 further includes a protrusion or hook 724. As best illustrated in FIGS. 3C, 4A, and 4B, coupled to the protrusion 724 is a resilient member 726 that is also coupled to the first pillar 236 of the rear side 220 of the front housing cover 200. The resilient member 726 is configured to bias the sliding plate 700 to the released position illustrated in FIGS. 3A, 3C, 4A, and 4B.

As further illustrated in FIG. 6A, the front side 702 of the sliding plate 700 includes a series of three front tooth receiving cavities 730(1)-730(3). Other embodiments may include additional or fewer front tooth receiving cavities. The first and second front tooth receiving cavities 730(1), 730(2) each include an inclined surface 732(1), 732(2), respectively, and a vertical surface 734(1), 732(2), respectively. Furthermore, the third front tooth receiving cavity 730(3) only includes a vertical surface 734(3). As further explained below and illustrated in FIGS. 3A and 4A, the front tooth receiving cavities 730(1)-730(3) are sized and shaped to receive and/or mate with the tooth 560 of the lever 500. The first front tooth receiving cavity 730(1) is disposed more proximate to the first edge 706 of the sliding plate 700 than the other front tooth receiving cavities 730(2), 730(3), while the third front tooth receiving cavity 730(3) is disposed farther from the first edge 706 of the sliding plate 700 than the other front tooth receiving cavities 730(1), 730(2). Thus the second front tooth receiving cavity 730(2) is disposed between the first and third front tooth receiving cavities 730(1), 730(3).

The front side 702 of the sliding plate 700 further includes a horizontal protrusion or ledge 770. As illustrated in FIG. 6A, the horizontal protrusion 770 extends outwardly from the front side 702 of the sliding plate 700 proximate to the second edge 708, and above the cutaway portion 722, but below the upper elongated slot 720. The horizontal protrusion 770 spans across a portion of the front side 702 of the sliding plate 700 from the second edge 708, but is spaced from the third front tooth receiving cavity 730(3) by a passage 772. Some embodiments of the sliding plate 700, however, may not contain a horizontal protrusion 770.

The sliding plate 700 also includes a rack 750 disposed along the top edge 710 of the sliding plate 700. As illustrated, the rack 750 spans substantially across the top edge 710 from the first edge 706 to the second edge 708. The rack 750 includes a set of equally spaced and sized teeth 752.

As best illustrated in FIG. 6B, proximate to the top edge 710 and the second edge 708 is a set of rear tooth receiving cavities 760(1)-760(3). Furthermore, the rear tooth receiving cavities 760(1)-760(3) are disposed on the rear side 704 of the sliding plate 700. As illustrated, the rear tooth receiving cavities 760(1)-760(3) each include an inclined surface 762(1)-762(3), respectively, and a vertical surface 764(1)-762(3), respectively. As further explained below and illustrated in FIGS. 3C and 4B, the rear tooth receiving cavities 760(1)-760(3) are configured to receive and/or mate with the extension tooth 930 of the retention member 900. The third rear tooth receiving cavity 760(3) is disposed more proximate to the second edge 708 of the sliding plate 700 than the other rear tooth receiving cavities 760(1), 760(2), while the first rear tooth receiving cavity 760(1) is disposed farther from the second edge 708 of the sliding plate 700 than the other tooth receiving cavities 760(2), 760(3). Thus the second rear tooth receiving cavity 760(2) is disposed between the first and third rear tooth receiving cavities 760(1), 760(3).

As best illustrated in FIGS. 6A and 6B, the sliding plate 700 further includes a contact plate 740 rotatably coupled to the first edge 706 of the sliding plate 700. The contact plate 740 includes a first end 742 and an opposite second end 744. The second end 744 is rotatably coupled to the first edge 706 of the sliding plate 700 such that the contact plate 740 rotates about axis D between the deployed position, where the contact plate 740 extends perpendicular from the rear side 704 of the sliding plate 700 and the first end 742 of the contact plate 740 is spaced from the rear side 704 of the sliding plate 700, and the stowed position, where the first end 742 is disposed proximate to the rear side 704 of the sliding plate 700 and the contact plate 740 is parallel with the rear side 704 of the sliding plate 700 (not illustrated). A resilient member 746 is coupled to the second side 744 and configured to bias the contact plate 740 to the deployed position. As best illustrated in FIGS. 3B and 3C, the contact plate 740 is configured to rotate from the deployed position to the stowed position as a toy vehicle travels over the ledge 136 of the second track 130 of the base 100 and past the contact plate 740 (i.e., the toy vehicle contacts and rotates the contact plate 740 to the stowed position). A stopper or backstop may prevent the contact plate 740 from over-rotating past the stowed position and/or the deployed position. Once the toy vehicle has passed the first end 742 of the contact plate 740, the resilient member 746 biases the contact plate 740 back into the illustrated deployed position.

Figure 7B:
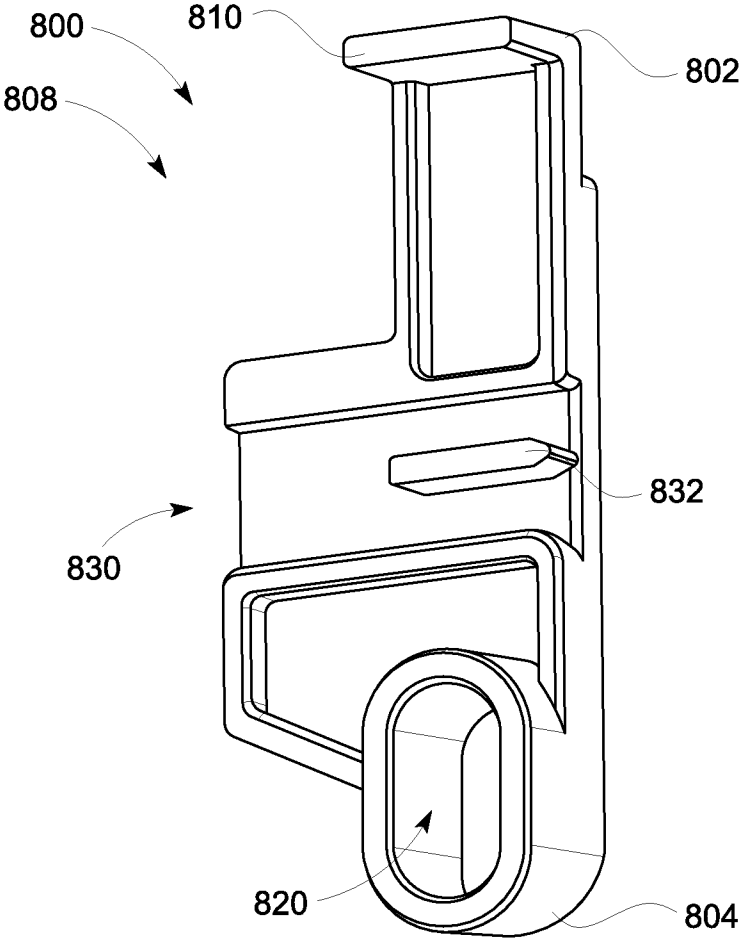
FIG. 7B illustrates a rear elevational view of the elongate member illustrated in FIG. 7A.
Figure 7A:
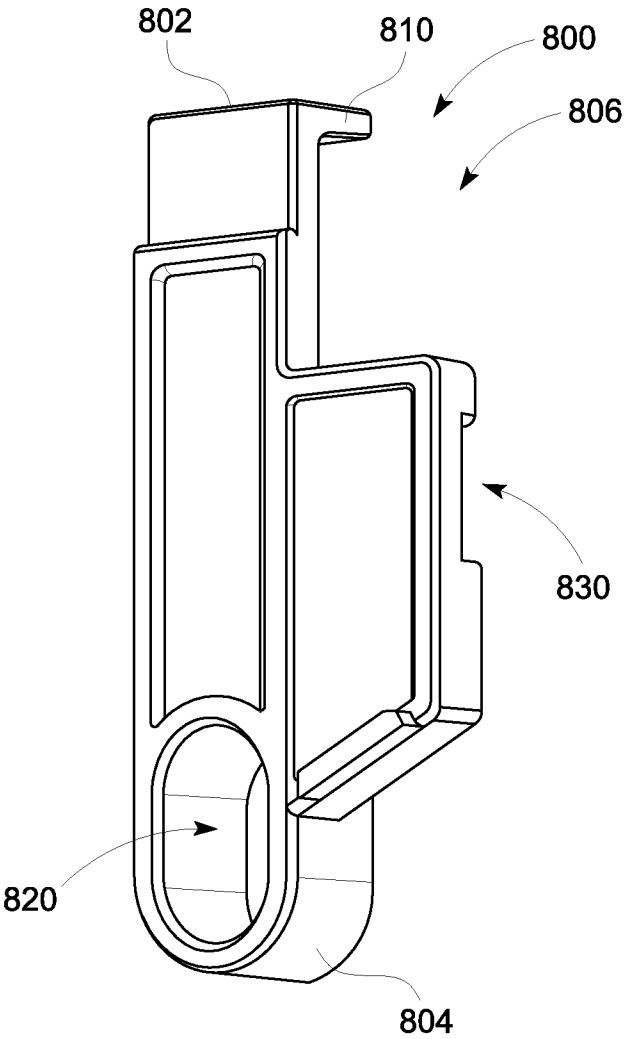
FIG. 7A illustrates a front elevational view of an elongate member of the embodiment of the toy vehicle launcher playset illustrated in FIG. 1A.

Turning to FIGS. 7A and 7B, illustrated is the elongate member 800 of the launch mechanism 600. The elongate member 800 includes a top end 802 and an opposite bottom end 804. The elongate member 800 further includes a front side 806 and an opposite rear side 808. Extending substantially horizontally from the top end 802 and from the rear side 808 of the elongate member 800 is a contact platform 810. Moreover, the bottom end 804 of the elongate member 800 is curved, and the elongate member 800 includes a slot 820 disposed proximate to the bottom end 804. As best illustrated in FIG. 3D, a fastener (e.g., screw, pin, bolt, rivet, etc.) 830 is disposed through the slot 820 to slidably secure the elongate member 800 to the rear side 220 of the front housing cover 200 such that the elongate member 800 is configured to slide along plane E. The length of the slot 820 limits the sliding movement of the elongate member 800. As further illustrated in FIGS. 7A and 7B, disposed within the rear side 808 of the elongate member 800, between the top end 802 and the bottom end 804, is a channel 830. The channel 830 spans substantially across the rear side 808 of the elongate member 800. Moreover, the channel 830 includes a protrusion 832 that is centrally disposed within the channel 830 and extends horizontally through at least a portion of the channel 830. Some embodiments of the elongate member 800, however, may not contain a channel 830 and protrusion 832.

Figure 8B:
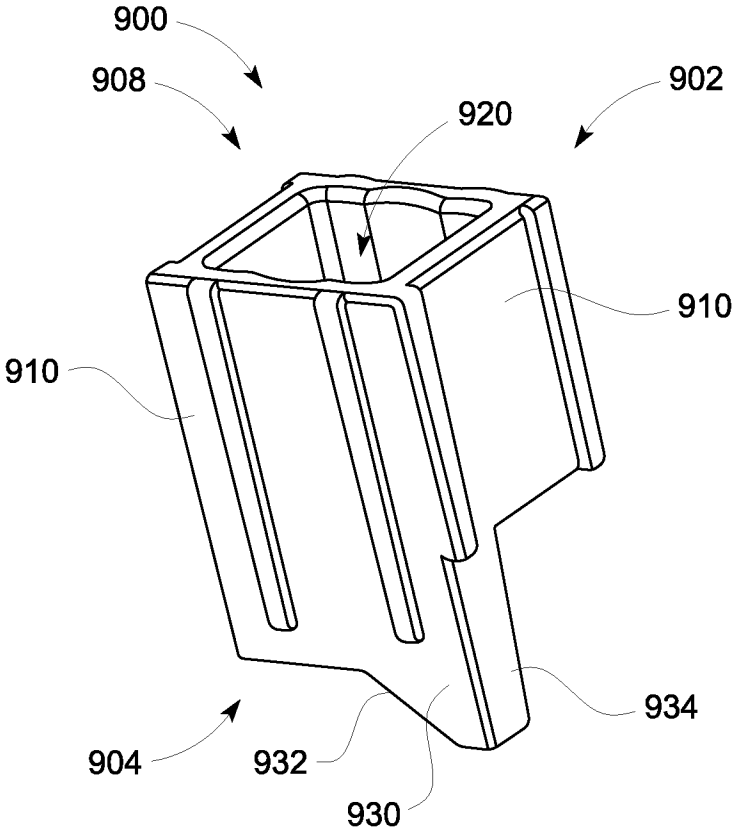
FIG. 8B illustrates a rear perspective view of the retention member illustrated in FIG. 8A.
Figure 8A:
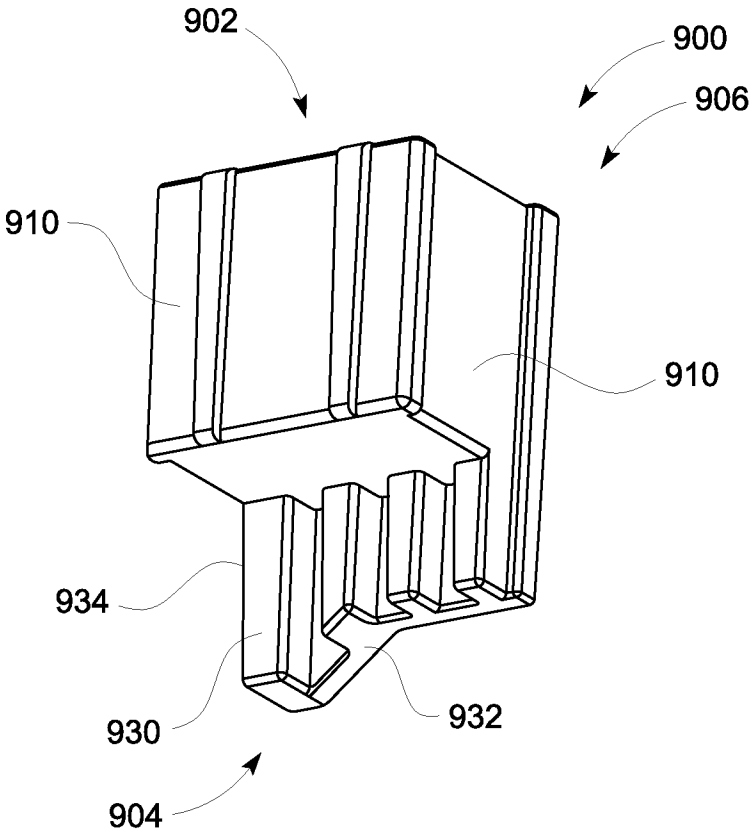
FIG. 8A illustrates a front perspective view of a retention member of the embodiment of the toy vehicle launcher playset illustrated in FIG. 1A.

Turning to FIGS. 8A and 8B, illustrated is the retention member 900 of the launch mechanism 600. As illustrated, the retention member 900 is substantially rectangular with a top side 902, an opposite bottom side 904, a front side 906, and a rear side 908 disposed opposite of the front side 906. Disposed within the top side 902, and defined by a series of sidewalls 910, is a cavity 920. As best illustrated in FIGS. 3A, 3C, 3D, 4A, and 4B, the cavity 920 is configured to receive a resilient member 922. Furthermore, extending from the bottom side 904, proximate to the rear side 908, is an extension tooth 930. As illustrated, the extension tooth 930 includes an inclined surface 932 and a vertical surface 934. As best illustrated in FIGS. 3C and 4B, the extension tooth 930 is size and shaped to be received and mated with the rear tooth receiving cavities 760(1)-760(3). When disposed within one of the rear tooth receiving cavities 760 (1)-760-(3), the inclined surface 932 of the extension tooth 930 is configured to align with the inclined surface 762(1)-762(3) of that respective rear tooth receiving cavity 760(1)-760(3), and the vertical surface 934 is configured to align with the vertical surface 764(1)-764(3) of that respective rear tooth receiving cavity 760(1)-760(3).

Moreover, as best illustrated in FIG. 3C, the retention member 900 is disposed within the cavity 230 of the rear side 220 of the front housing cover 200. The resilient member 922 is configured to act against the upper wall 234 of the cavity 230 to bias the retention member 900 to the lower engaged position illustrated in FIG. 3C, where the top side 902 of the retention member 900 is disposed away from the upper wall 234, and the extension tooth 930 is received by one of the rear tooth receiving cavities 760(1)-760(3). Furthermore, as explained in further detail below, the retention member 900 is configured to slide vertically within the cavity 230 along plane E. Sometimes the sliding of the retention member 900 is in unison with sliding of the elongated member 800 to a disengaged position. In the disengaged position, the resilient member 922 may be compressed, the top side 902 of the retention member 900 may be disposed proximate to the upper wall 234 of the cavity 230, and the extension tooth 930 may no longer be received within one of the rear tooth receiving cavities 760(1)-760(3).

As best illustrated in FIGS. 3A, 3C, 4A, and 4B, the elongate member 800 and the lower portion 510 of the lever 500 are disposed on the front side 702 of the sliding plate 700. The slidable tooth 560 of the lever 500 is sized and shaped to be received in one of the front tooth receiving cavities 730(1)-730(3), while the aperture 548 is configured to receive the second pillar 237 of the front housing cover 200 that extends through the lower elongated slot 728 of the sliding plate 700. Moreover, the contact portion 526 of the lower portion 510 of the lever 500 is disposed below the bottom end 804 of the elongate member 800. The contact portion 526 is spaced from the bottom end 804 of the elongate member 800 such that, when the lever 500 is rotated far enough about axis A, the contact portion 526 impacts the bottom end 804 of the elongate member 800 and may translate the elongate member 800 upward along plane E. In the resting position illustrated in FIGS. 3A, 3C, 4A, and 4B, the horizontal protrusion 770 of the sliding plate 700 is vertically aligned with the channel 830 of the elongate member 800.

As further illustrated, while the elongate member 800 is disposed on the front side 702 of the sliding plate 700, the top end 802 of the elongate member 800 is disposed higher in height than the rack 750, and the contact platform 810 of the elongate member 800 extends over and beyond the teeth 752 of the rack 750. As further explained, the contact platform 810 is in engagement with the bottom side 908 of the retention member 900. Thus, as illustrated, the retention member 900 is disposed above the rack 752, but the extension tooth 930 of the retention member 900 is configured to descend downwardly beyond the rack 752 and into engagement with one of the rear tooth receiving cavities 760(1)-760(3).

As best illustrated in FIGS. 3B, 3C, and 4B, the contact plate 740 extends rearwardly from the sliding plate 700, through the cutaway portion 452 of the intermediate housing cover 400, and into the space above the inclined portion 138 and/or the ledge 136 of the second track 130 of the base 100.

The launch mechanism 600 further includes a dial 1000, which is best illustrated in FIGS. 1A, 3A, and 3C. As illustrated, the dial 1000 includes a gear 1002 having a plurality of teeth that are configured to intermesh with the teeth 752 of the rack 750 of the sliding plate 700. Furthermore, the gear 1002 is disposed around an axle 1006 that extends through both sides of the gear 1002. Coupled to the front side of the gear 1002 is an indicator 1010. As illustrated, the indicator 1010 includes a first end 1012 and a second end 1014. The second end 1014 of the indicator is coupled to the axle 1006 and the gear 1002, while the first end 1012 of the indicator 1010 extends through the slot 214 of the display 212 of the front housing cover 200, as illustrated in FIG. 1A. When the sliding plate 700 slides along plane C, the rack 750 interacts with the gear 1002 of the dial 1000 to rotate the indicator 1010 about axis F.

The playset 10 and the launch mechanism 600 described herein enables a user to repeatedly actuate the lever 500 a set number of times to trigger the launch mechanism 600 to launch a toy vehicle 600. Each actuation of the of the lever 500 increases the amount of potential energy stored in the launch mechanism 600. Once the launch mechanism 600 has stored its maximum amount of potential energy, a subsequent actuation of the lever 500 releases the launch mechanism 600 to launch a toy vehicle 600. In operation, a user grasps the upper portion 570 of the lever 500 and rotates (e.g., pulls or pumps) the upper portion 570 of the lever 500 downward toward the base 100 and away from the first side 260 of the front housing cover 200 (i.e., the user rotates the lever 500 counter-clockwise when facing the front 12 of the playset 10). This rotates the lever 500 about axis A. Upon first actuation of the lever 500, the tooth 560 of the lower portion 510 of the lever 500 is disposed within the first front tooth receiving cavity 730(1), while the extension tooth 930 of the retention member 900 is disposed within the first rear receiving cavity 760(1). As the lever 500 is initially actuated, the tooth 560 is also rotated toward the first side 16 of the playset 10 such that the vertical surface 564 of the tooth 560 acts on the vertical surface 734(1) of the first front tooth receiving cavity 730(1) to pull the sliding plate 700 along plane C toward the first side 16 of the playset 10. As the sliding plate 700 initially slides along plane C, the inclined surface 762(1) of the first rear tooth receiving cavity 760(1) acts on the inclined surface 932 of the extension tooth 930 of the retention member 900 to translate the retention member 900 upward along plane E (e.g., without the aid of the elongate member 800) until the extension tooth 930 is out of engagement with the first rear tooth receiving cavity 760(1). Continual rotation of the lever 500 continues to pull the sliding plate 700 along plane C via the tooth 560 acting on the vertical surface 734(1) of the first front tooth receiving cavity 730(1) until the second rear tooth receiving cavity 760(2) slides under the extension tooth 930 and the extension tooth 930 becomes engaged within the second rear tooth receiving cavity 760(2).

Furthermore, as the sliding plate 700 slides along plane C, the horizontal protrusion 770 of the sliding plate 700 slides within the channel 830 of the elongate member 800. More specifically, the horizontal protrusion 770 may slide through the channel 830 of the elongate member 800 until the horizontal protrusion 770 is disposed over, and adjacent to, the protrusion 832 of the elongate member 800. In the initial position illustrated in FIGS. 3A, 4A, and 4B, the protrusion 832 of the elongate member 800 is aligned with the passage 772 of the sliding plate 700, and thus, the elongate member 800 is free to translate along plane E. After the initial actuation of the lever 500, however, the elongate member 800 is misaligned with the passage 772 such that the horizontal protrusion 700 is disposed within the channel 830 and over the protrusion 832 of the elongate member 800, preventing the elongate member 800 from translating upward along plane E. In other words, if the lever 500 is pulled or actuated such that the contact portion 526 of the lower portion 510 of the lever 500 impacts the bottom end 804 of the elongate member 800, the horizontal protrusion 770 acts on the protrusion 832 to prevent the elongate member 800 from translating upward along plane E.

If the user wishes to continue to incrementally increase the launch power (i.e., increasing the stored the potential energy) of the launch mechanism 600, then the user may release the lever 500, or manually return the lever 500 to its original unactuated position (i.e., clockwise rotation when facing the front 12 of the playset 10), where the upper portion 570 of the lever 500 is disposed against the first side 260 of the front housing cover 200. If the user releases the lever 500, the lever 500 returns to the original unactuated position via the biasing force of the resilient member 524 acting on the first end 520 of the lower portion 510 of the lever 100. In either event, as the lever 500 is returned to the original unactuated position, the inclined surface 562 of the tooth 560 acts on the inclined surface 732(1) of the first front tooth receiving cavity 730(1). Because the extension tooth 930 of the retention member 900 is engaged in the second rear tooth receiving cavity 760(2), and because the vertical surface 764(2) of the second rear tooth receiving cavity 760(2) is engaged with the vertical surface 934 of the extension tooth 930, the sliding plate 900 is prevented from sliding along plane C toward the second side 18 of the playset 10. With the lever 500 being rotated toward the original unactuated position, and with the retention member 900 preventing the sliding plate 700 from moving along plane C toward the second side 18 of the playset 10, the inclined surface 732(1) of the first front tooth receiving cavity 730(1) acts on the inclined surface 564 of the tooth 560 to cause the sliding toothed member 550 to slide downwardly along plane B into the receiving portion 540 of the lower portion 510 of the lever 500. As the lever 500 is rotated to the original unactuated position, and as the tip or end of the tooth 560 clears the tip or end of the inclined surface 732(1) of the first front tooth receiving cavity 730(1), the resilient member 566 biases the tooth 560 out of the receiving portion 540 along plane B, and into engagement with the second front tooth receiving cavity 730(2). This process (e.g., repeated pumping or pulling of the lever 500) may be repeated until the retention member 900 becomes engaged with the third rear tooth receiving cavity 760(3) and the tooth 560 of the lever 500 is configured to act on the vertical surface 734(3) of the third front tooth receiving cavity 730(3). In this position, the launch mechanism 600 is fully loaded to its maximum power (i.e., the largest amount of stored potential energy) for launching a toy vehicle along the second track 130.

As the sliding plate 700 slides toward the first side 16 of the playset 10, the contact plate 740, as best illustrated in FIG. 3B, simultaneously slides through the cutaway portion 452 of the intermediate housing cover 400 toward the first side 16 of the playset 10. In addition, the dial 1000 is configured to rotate simultaneously with the sliding of the slide plate 700 via the gear 1002 of the dial 1000 interacting with the rack 750 of the slide plate 700. In one example, when the slide plate 700 is in the released position illustrated in the figures, the indicator 1010 of the dial 1000 may point to "empty" or "E" on the display 210 of the front housing cover 200. As the sliding plate 700 is moved incrementally toward the first side 16 of the playset 10 with the incremental pulls or pumps of the lever 500, the indicator 1010 of the dial 1000 may also incrementally rotate to point toward "full" or "F" on the display 210.

The actuations of the lever 500 described above are not "full" pull or pumps of the lever 500. The lever 500 is only rotated until the contact portion 526 of the lower portion 510 of the lever 500 impacts the bottom end 804 of the elongate member 800, where engagement of the horizontal protrusion 770 with the protrusion 832 of the elongate member 800 prevents the elongate member 800 from translating upward along plane E. In other words, the alignment of the horizontal protrusion 770 over the protrusion 832 of the elongate member 800 also prevents further rotation of the lever 500. However, after repeated actuations or pulls of the lever 500, the sliding plate 700 may have slid far enough along plane C toward the first side 16 of the playset 10 that the end of the horizontal protrusion 770 disposed proximate to the second edge 708 of the sliding plate 700 is disposed within the channel 830 of the elongate member 800 (i.e., when the tooth 560 of the lever 500 is be disposed in the third front tooth receiving cavity 730(3)). Subsequent actuation of the lever 500 causes the this end of the horizontal protrusion 770 of the sliding plate 700 to slide out of the channel 830 of the elongate member 800, which then enables the lever 500 to be fully rotated, where, once the contact portion 526 of the lower portion 510 of the lever 500 impacts the bottom end 804 of the elongate member 800, the lever 500 may be continually rotated (i.e., the lever 500 until the second end 530 of the lower portion 510 of the lever 500 is disposed against the top side 102 of the base 100) to cause the elongate member 800 to translate upward along plane E. As the elongate member 800 is translated upward, the contact platform 810 of the elongate member 800 acts on the bottom side 908 of the retention member 900 to translate the retention member 900 upward along plane E until the extension tooth 930 is disengaged from the rear tooth receiving cavities 760(1)-760(3). Simultaneously, the tooth 560 is rotated far enough about axis A that the tooth 560 is no longer disposed within any of the front tooth receiving cavities 730(1)-730(3). Thus, when the lever 500 is actuated enough times, the sliding plate 700 is no longer held in place by either the tooth 560 of the lever 500 or the extension tooth 930 of the retention member 900, and the resilient member 726 is able to act on the sliding plate 700 to move the sliding plate 700, and subsequently the contact plate 740, along plane C in the direction of the second side 18 of the playset 10.

In other embodiments of the launch mechanism 600, where the elongate member 800 does not contain a channel 830 or protrusion 832, and the sliding plate 700 does not contain horizontal protrusion 770 and passage 772, as described above, the launch mechanism 600 may be fully actuated to launch a toy vehicle during any actuation stage (i.e., any actuation of the lever 500). Because, in this embodiment, the sliding plate 700 does not contain the horizontal protrusion 770, and because the elongate member 800 does not contain the channel 830 and protrusion 832, the elongate member 800 is capable of being translated upward along plane E whenever the user decides to fully actuate the lever 500 (i.e., rotate the lever 500 until the second end 530 of the lower portion 510 of the lever 500 is disposed against the top side 102 of the base 100), as described above. Thus, according to this embodiment, a user may load the launch mechanism 600 with a desired amount of potential energy by incrementally actuating the lever 500 (e.g., pump, pull, ratchet, etc.) with a series of "half" pumps. Once the user decides launch mechanism 600 has stored the desired amount of potential energy, the user may fully actuate the lever 500 to cause the launch mechanism 600 to launch the toy vehicle. This embodiment enables the user to set the distance and/or speed in which the launch mechanism 600 launches the toy vehicle.

For either of the launch mechanism 600 embodiments described, the release of the sliding plate 700 and the contact plate 740 causes the contact plate 740 to impact a toy vehicle positioned on the inclined portion 138 of the second track 130 proximate to the ledge 136 to propel the toy vehicle along the second track 130. In other words, the resilient member 726 propels the sliding plate 700 along plane C at a rapid speed or pace toward the second side 18 of the playset 10. Simultaneously, the contact plate 740 is also propelled along plane C, but over the second track 130 of the base 100. When a toy vehicle is disposed on the inclined portion 138 of the second track 130 proximate to the ledge 136, the contact plate 740 impacts the toy vehicle and propels the toy vehicle up the inclined portion 138 and out of the lower passage 362. In some embodiments, the propelled toy vehicle impacts the swing door 364 as it is propelled along the second track 130, causing the swing door 364 to swing open.

Furthermore, in some embodiments, the toy vehicle may be placed on the inclined portion 138 of the second track 130 by a user. In other embodiments, a toy vehicle may enter the playset 10 by traveling along a track coupled to the first end 132 of the second track 130. The toy vehicle may travel past the ledge 136 and onto the inclined portion 138. As this happens, the toy vehicle may impact the contact plate 740, causing it to rotate about axis D from the deployed position illustrated to a stowed position to enable the toy vehicle to pass the contact plate 740 unimpeded. Once the toy vehicle passes the contact plate 740, the resilient member 746 biases the contact plate 740 to rotate about axis D and return to the deployed position. In the event the toy vehicle is traveling at a slow enough speed that the inclined portion 138 of the second track 130 slows the toy vehicle to a stop, or the toy vehicle enters the playset 10 without enough speed to open the swing door 364 (i.e., impacting the swing door 364 causes the toy vehicle to stop), the toy vehicle may travel backwards down the inclined portion 138 until it contacts the ledge 136. The user may then actuate, pump, or ratchet the lever 500 until the launch mechanism 600 is released, launching the toy vehicle along the second track 130 of the playset 10, and onto any other track or playset coupled to the second end 134 of the second track 130.

As described above, this interaction between the launch mechanism 600 components enables a user to incrementally load the launch mechanism 600 in order to launch a toy vehicle. In some embodiments, the launch mechanism 600 may be loaded to a desired amount, which enables the user to selectively choose how fast to launch the toy vehicle along the second track 130. With the playset 10 illustrated and described above, the user is presented a play pattern where a toy vehicle may stop at the playset 10 when the toy vehicle may, according to the play pattern, "need to be refueled." The subsequent pumps of the lever 500 may mimic, according to the play pattern, the pumping of fuel to the toy vehicle. Essentially, the more pumps of the lever 500, the more fuel given to the toy vehicle. The toy vehicle may be launched when the "fuel tank" of the toy vehicle has been "filled."

In the preceding detailed description, reference is made to the accompanying figures which form a part hereof wherein like numerals designate like parts throughout, and in which is shown, by way of illustration, some of the embodiments that may be practiced. It is to be understood that other embodiments may be utilized, and structural or logical changes may be made without departing from the scope of the present disclosure. Therefore, the preceding detailed description is not to be taken in a limiting sense, and the scope of embodiments is defined by the appended claims and their equivalents.

Aspects of the disclosure are disclosed in the description herein. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy vehicle launcher comprising:

a launcher housing having a plurality of sidewalls that define an interior cavity;

a handle attached to the launcher housing such that a first end of the handle is at least partially disposed within the interior cavity, the handle being configured to move with respect to the launcher housing;

a slidable plate at least partially disposed within the interior cavity of the launcher housing, operatively coupled to first end of the handle, and movable through at least a portion of the interior cavity of the launcher housing, the slidable plate including a first notch and a second notch displaced from the first notch;

a first biasing element coupling the slidable plate to at least one of the plurality of sidewalls of the launcher housing, the first biasing element biasing the slidable plate in a first direction within the interior cavity of the launcher housing, wherein movement of the handle causes the slidable plate to slide in a second direction that is opposite the first direction and is against the bias of the first biasing element;

a retention member disposed within the interior cavity of the launcher housing proximate to the slidable plate and configured to engage and disengage with the first notch and the second notch of the slidable plate as the slidable plate slides within the interior cavity of the launcher housing in the first direction and as the slidable plate slides within the interior cavity of the launcher housing in the second direction;

a second biasing element attaching the retention member within the interior cavity of the launcher housing to at least one of the plurality of sidewalls of the launcher housing, the second biasing element biasing the retention member into contact with the slidable plate; and an impactor for impacting and launching a toy vehicle is attached to the slidable plate and disposed outside of the interior cavity of the launcher housing.

2. The toy vehicle launcher of claim 1, further comprising:

an external indicator coupled to at least one of the sidewalls of the launcher housing, the external indicator including a first configuration and a second configuration; and a translation mechanism disposed between the slidable plate and the external indicator, wherein the translation mechanism reconfigures the external indicator between the first configuration and the second configuration when the slidable plate slides in the first direction or the second direction.

3. The toy vehicle launcher of claim 2, wherein the translation mechanism is a rack and pinion mechanism.

4. The toy vehicle launcher of claim 1, wherein the launcher housing is disposed proximate to a toy vehicle track having a pathway configured to receive toy vehicles.

5. The toy vehicle launcher of claim 4, wherein the impactor extends from the launcher housing into the pathway of the toy vehicle track.

6. The toy vehicle launcher of claim 5, wherein the impactor is rotatably coupled to the slidable plate between a deployed position, where the impactor extends into the pathway, and a stowed position, where the impactor is disposed against the slidable plate, the toy vehicle launcher further comprising:

a third biasing element that biases the impactor into the deployed position.

7. The toy vehicle launcher of claim 1, wherein the impactor impacts a toy vehicle disposed on the toy vehicle track when the slidable plate translates along the first direction via the first biasing element.

8. A toy vehicle launcher comprising:

a launcher housing having a plurality of sidewalls that define an interior cavity;

a handle rotatably attached to the launcher housing, the handle having a first end disposed within the interior cavity of the launcher housing and an opposite second end disposed outside of the interior cavity of the launcher housing;

a slidable plate operatively coupled to the first end of the handle and incrementally movable through at least a portion of the interior cavity of the launcher housing via successive rotations of the handle, the slidable plate including a plurality of sequential primary notches;

a first biasing element coupling the slidable plate to at least one of the plurality of sidewalls of the launcher housing, the first biasing element biasing the slidable plate in a first direction within the interior cavity of the launcher housing, wherein successive rotations of the handle translates the slidable plate in increments along a second direction that is opposite the first direction and is against the bias of the first biasing element;

a retention member disposed within the interior cavity of the launcher housing proximate the slidable plate and configured to engage and disengage with the plurality of primary notches of the slidable plate as the slidable plate translates along the first direction and as the slidable plate translates along the second direction;

a second biasing element attaching the retention member to at least one of the plurality of sidewalls of the launcher housing, the second biasing element biasing the retention member into engagement with one of the plurality of primary notches; and an impactor for impacting and launching a toy vehicle is attached to the slidable plate and disposed outside of the interior cavity of the launcher housing.

9. The toy vehicle launcher of claim 8, wherein the slidable plate further comprises:

a plurality of sequential secondary notches.

10. The toy vehicle launcher of claim 9, wherein the handle further comprises:

an engagement member slidably coupled to the handle proximate to the first end of the handle and configured to engage one of the plurality of secondary notches.

11. The toy vehicle launcher of claim 10, wherein rotation of the handle in a first rotational direction causes the engagement member to engage a first secondary notch of the slidable plate and translate the slidable plate along the second direction a first amount.

12. The toy vehicle launcher of claim 11, wherein translation of the slidable plate along the second direction the first amount causes the retention member to disengage from a first primary notch and engage a second primary notch that is sequential to the first primary notch.

13. The toy vehicle launcher of claim 12, wherein rotation of the handle in a second rotational direction that is opposite the first rotational direction causes the engagement member to disengage from the first secondary notch of the slidable plate and engage a second secondary notch of the slidable plate that is sequential to the first secondary notch of the slidable plate.

14. The toy vehicle launcher of claim 13, wherein engagement of the retention member with one of the plurality of primary notches of the slidable plate prevents the slidable plate from translating along the first direction.

15. A toy vehicle launcher comprising:

a launcher housing having a plurality of sidewalls that define an interior cavity;

a handle rotatably coupled to the launcher housing, the handle having a first end disposed within the interior cavity of the launcher housing and an opposite second end disposed outside of the interior cavity of the launcher housing, the handle being configured to rotate a first amount and a second amount;

a slidable plate disposed within the interior cavity of the launcher housing and operatively coupled to the first end the handle, the slidable plate being configured to move at least partially through the interior cavity of the launcher housing in increments as the handle is successively rotated the first amount, the slidable plate including a plurality of sequential notches;

a first biasing element coupling the slidable plate to at least one of the plurality of sidewalls of the launcher housing, the first biasing element biasing the slidable plate in the first direction within the interior cavity of the launcher housing, wherein successive rotations of the handle the first amount translates the slidable plate in increments along a second direction that is opposite the first direction and is against the bias of the first biasing element;

a retention member disposed within the interior cavity of the launcher housing proximate the slidable plate and configured to engage and disengage with the plurality of notches of the slidable plate as the slidable plate slides within the interior cavity of the launcher housing in the first direction and as the slidable plate slides within the interior cavity of the launcher housing in the second direction;

a second biasing element attaching the retention member to at least one of the plurality of sidewalls of the launcher housing, the second biasing element biasing the retention member into engagement with one of the plurality of notches, wherein rotation of the handle the second amount disengages the retention member from the plurality of notches and enables the first biasing element to translate the slidable plate along the first direction; and an impactor for impacting and launching a toy vehicle is attached to the slidable plate and disposed outside of the interior cavity of the launcher housing.

16. The toy vehicle launcher of claim 15, wherein the first amount of rotation is less than the second amount of rotation.

17. The toy vehicle launcher of claim 15, wherein engagement of the retention member with one of the plurality of notches prevents the slidable plate from translating along the first direction.

18. The toy vehicle launcher of claim 15, further comprising:

an elongate member disposed within the interior cavity of the launcher housing and slidably coupled to at least one of the plurality of sidewalls of the launcher housing, the elongate member having a first end and a second end, the first end of the elongate member being in abutment with the retention member.

19. The toy vehicle launcher of claim 18, wherein the handle comprises a contact portion disposed within the housing on the first end of the handle.

20. The toy vehicle launcher of claim 19, wherein rotation of the handle the second amount causes the contact portion to impact the second end of the elongate member and move the elongate member and retention member until the retention member is disengaged from the plurality of notches.

* * * * *